US008430587B2

(12) United States Patent
De Laforcade

(10) Patent No.: US 8,430,587 B2
(45) Date of Patent: Apr. 30, 2013

(54) DEVICE FOR PACKAGING AND APPLYING A COSMETIC PRODUCT

(75) Inventor: Vincent De Laforcade, Rambouillet (FR)

(73) Assignee: L'Oreal, Paris (FR)

( * ) Notice: Subject to any disclaimer, the term of this patent is extended or adjusted under 35 U.S.C. 154(b) by 648 days.

(21) Appl. No.: 12/633,546

(22) Filed: Dec. 8, 2009

(65) Prior Publication Data

US 2010/0143021 A1 Jun. 10, 2010

Related U.S. Application Data

(60) Provisional application No. 61/138,332, filed on Dec. 17, 2008.

(30) Foreign Application Priority Data

Dec. 9, 2008 (FR) ..... 08 58387

(51) Int. Cl.
*A46B 11/00* (2006.01)

(52) U.S. Cl.
USPC ..... 401/121; 401/4; 401/126

(58) Field of Classification Search ..... 401/4, 121, 401/122, 126, 129; 132/293, 307, 313, 306, 132/318
See application file for complete search history.

(56) References Cited

U.S. PATENT DOCUMENTS 2,071,747 A 2/1937 Houlihan
3,694,096 A 9/1972 Seidler
3,908,675 A * 9/1975 Spatz et al. ..... 132/293
4,802,797 A * 2/1989 Cole ..... 401/122
2006/0051153 A1 3/2006 Delage

FOREIGN PATENT DOCUMENTS

| | | |
|---|---|---|
| EP | 0 688 516 | 12/1995 |
| FR | 2 513 498 | 4/1983 |
| FR | 2 544 970 | 11/1984 |
| FR | 2 633 167 | 12/1989 |
| FR | 2 798 646 | 3/2001 |

OTHER PUBLICATIONS

European Search Report dated Dec. 17, 2010.

* cited by examiner

*Primary Examiner* — David Walczak
(74) *Attorney, Agent, or Firm* — Oblon, Spivak, McClelland, Maier & Neustadt, L.L.P.

(57) ABSTRACT

The present invention relates to an application device comprising:

a base comprising:

an applicator configured to spread a cosmetic product over a bodily application surface, a member for supporting the applicator comprising a relief, a tube capable of surrounding the applicator, said base being able to be moved relative to the tube between a high position and a low position, said tube defining a path for the sliding of the supporting member comprising a plurality of irregularities against which said relief of the supporting member is able to slide so as to create a jump of the applicator, said sliding path comprising a sliding edge suitable for guiding the movement of the base from its low position to its high position.

14 Claims, 15 Drawing Sheets

DEVICE FOR PACKAGING AND APPLYING A COSMETIC PRODUCT

CROSS REFERENCE TO RELATED APPLICATIONS

This document claims priority to French Application Number 08 58387, filed Dec. 9, 2008 and U.S. Provisional Application No. 61/138,332, filed Dec. 17, 2008, the entire contents of each which are incorporated herein by reference.

FIELD OF THE INVENTION

The present invention relates to a device for applying a cosmetic product, including a care product and an assembly for packaging and applying such a cosmetic product.

BACKGROUND OF THE INVENTION

Discussion of Background

A preferred, but not exclusive, field of the present invention relates to the application of a cosmetic product in the form of powder by virtue of an applicator of the foam or powder puff type.

"Cosmetic product" means a product as defined in Directive 93/35/CEE of the Council of 14 Jun. 1993.

Documents EP0688516, FR2513498, FR2544970, FR2633167, FR2798646 and U.S. Pat. No. 3,694,096 disclose examples of devices for applying a cosmetic product, in particular in powder form, of the prior art.

Document FR2513498 discloses a make-up powder box with double compartments communicating with one another, a first containing the cosmetic product, a second accommodating a tube. A brush is mounted across this tube. In order to take off a quantity of product, the user turns the box over so as to transfer the cosmetic product from the first to the second compartment. The product entering the second compartment can then adhere to the bristles of the brush. This brush can then be taken out of the tube for the purpose of applying the product.

A drawback associated with such a device is that the user cannot easily quantify the dose of product present on the applicator when the applicator is put in place on the tube and the box is turned over. In particular she cannot estimate whether one overturn is enough to correctly impregnate the brush with make-up product, this being notably dependent on the quantity of powder remaining in the first compartment. To ensure a correct impregnation, the user can then carry out several overturns of the device in order to release into the second compartment a quantity of product that she will judge a priori adequate. However, the particular features of powders is that they are very volatile. Therefore, an excess of product taken out may tend to fall on the clothes of the user at the time of extraction, or when applied to the skin surface in question. Moreover an excess of product taken out can with difficulty be replaced in the box thus resulting in a waste of product.

Document FR2798646 discloses a device for packaging and applying a product in the form of powder comprising a receptacle defining an internal space containing the product, a housing for accommodating an applicator and a permeable wall placed between this housing and the internal space. This device also comprises compression means suitable for causing an overpressure in the internal space in order to expel the product through the permeable membrane in contact with the applicator.

However, a disadvantage associated with such a device is again that it does not make it possible to obtain a correct dosage of the quantity of powder to be applied. Specifically, the transfer of product to the applicator is dependent on the compression force and the number of compressions applied by the user. Here again, loading the applicator with excess product can cause a waste of product and, in some cases, soiling of the user's clothes.

Documents FR2882506 and FR2915064 disclose examples of devices of the prior art comprising vibration means actuated with the aid of a switch.

SUMMARY OF THE INVENTION

An object of the present invention is therefore to provide a device that overcomes at least one of the abovementioned drawbacks.

An object of the present invention is also to provide a device having a new action of use.

An object of the present invention is also to provide a device that is easy to manufacture, simple to apply and has a moderate cost price.

Another object of the present invention is again to provide a device for procuring a make-up action or a treatment of the keratinous fibres that is fine and careful.

A further object of the present invention is to provide a device making it possible to adequately load the application surface to be made up or to be treated.

The present invention therefore has as its subject an application device comprising:

a base comprising:

an applicator configured to spread a cosmetic product on a bodily application surface, a member for supporting the applicator comprising a relief, a tube capable of surrounding the applicator, said base being able to be moved relative to the tube between a high position and a low position, said tube comprising a path for the sliding of the supporting member comprising a plurality of irregularities against which said at least one relief of the supporting member is able to slide so as to create a jump of the applicator, said sliding path comprising a sliding edge suitable for guiding the movement of the base, and in particular of the supporting member, from its low position to its high position.

The cosmetic product may be a product in liquid form or advantageously in powder form. This product may, for example, be a foundation, a concealer, an eyeshadow, a lipstick, a lip gloss, a nail varnish or a skin care product.

This guidance from the low position to the high position may comprise a crank relative to the tube. This crank may extend radially inwards relative to a cylindrical surface of the tube. It may in particular comprise a crank relative to a bottom of a guide groove. This crank may extend internally or externally relative to this bottom of said groove.

This plurality of irregularities may comprise a succession or series of irregularities. These irregularities and said at least one relief interact together so as to form a dosage-correction member for a taken dose in the direction of a reduction of impregnated product on the applicator.

By the term "to slide", it should be understood that the supporting member of the base can slide over a portion of the tube. The sliding path cannot go through. In other words, it may be closed off by a bottom.

This plurality of irregularities comprises at least two irregularities provided along the sliding path, preferably at least three, if necessary at least four, and even between five and twelve irregularities. These irregularities may comprise a series of protuberances or reinforcements. These irregularities may be in the continuity of each other or of one another. They may, if necessary, be spaced evenly or extend at variable distances along said sliding path. They may be provided along said path at respective distances of less than 10 mm, preferably less than 5 mm. This plurality of irregularities may be provided on a sliding edge or, if necessary, on the bottom of a sliding groove, one or both of its edges.

This plurality of irregularities may extend along a circular, helical, curvilinear or linear path. The relief of the supporting member may therefore be moved by sliding along the plurality of irregularities.

The supporting member may comprise at least one relief forming a skid capable of sliding along the plurality of irregularities. To do this, the supporting member may be moved by translation and/or rotation relative to the tube. In other words, the tube may comprise a plurality of reliefs on which at least one relief of the supporting member is capable of sliding. This plurality of reliefs may therefore comprise a toothed or notched sector of sliding path.

If necessary, said supporting member may comprise a plurality of reliefs. The supporting member may, for example, comprise at least two reliefs capable of interacting with a plurality of irregularities of the tube. It may also comprise at least two reliefs each capable of interacting with a plurality of respective irregularities of the tube. In other words, the tube may comprise two toothed sectors on which at least one respective relief of the supporting member is capable of sliding. These toothed sectors may if necessary extend over the tube in an opposed manner, and, if necessary, in a diametrically opposed manner. These sectors may extend from an inner surface of the tube. As a variant, they may be provided on an outer surface of the tube.

A relief may have at least a portion of dimension such that it can interfere between two successive irregularities. This relief may if necessary have a general shape that complements that of an irregularity. These reliefs may mesh into the irregularities. An interaction of the rack type may if necessary take place using two toothed ring sectors provided with respective teeth capable of meshing at least partly with one another.

The base may be able to move relative to the tube in a mounted position of the supporting member between a high position and a low position.

The sliding path is configured to guide in rotation and/or in translation said supporting member from its high position to its low position. It may also be configured to guide the supporting member from its high position to its low position and from its low position to its high position. This guidance is achieved by a sliding edge. This sliding edge alone may if necessary guide the movement of the supporting member relative to the tube. It may if necessary be provided with said irregularities.

This sliding edge therefore forms a high, called top, stop for the supporting member. It may also form a low, called bottom, stop for this member.

Such a device therefore makes it possible to create, via this interaction of the supporting member and the tube, a halting or jerky movement of the base so as to remove from the applicator a load of excess product. This interaction of the irregularities with matching reliefs thus creates a jump or shake of the applicator by a simple movement of the supporting member in frictional contact on or against the tube.

Such a device allows the applicator to preserve an efficient quantity of product and to cause the surplus of product present on this applicator to fall back by gravity into the receptacle.

It should be noted that one of the irregularities may comprise a relief for attaching the supporting member to the tube. In particular, this relief may be a protuberance, or rice grain, or any other relief used for the retention in an attaching closed low position of the base on the receptacle.

The supporting member may receive the applicator so as to surround it over at least a portion of its height. The base may form a cap closing off said tube. This base may form a cap designed to cover a delivery opening of a receptacle. More precisely, the supporting member, together with the applicator, may form a cap suitable for covering a delivery opening of a receptacle. The supporting member may form a member for gripping for the purpose of handling the applicator.

The applicator may be at least partly made of a material separate from the supporting member. The applicator may be fitted to the supporting member.

The applicator may comprise one or more application elements. This applicator may be chosen from a brush provided with a plurality of bristles, if necessary of the shaving brush or powder puff type, a foam, which may be either impermeable to the product to be taken out or adapted to absorb product, a woven, a non-woven or a felt. More generally, this applicator may be made of a porous or non-porous material. The applicator may, in particular in the latter case, comprise on its surface reliefs capable of loading it with product. If necessary, such a material may be rough. This applicator may if necessary be covered with flocking.

The applicator may be attached in movement to the supporting member. The applicator may be permanently attached to the supporting member by all appropriate means. As a variant, it may be fitted into said supporting member and be mounted removably. In the latter case, the applicator may, for example, be mounted by tight sleeve-fitting, screwing or snap-fitting onto said supporting member. This supporting member may retain the application elements of the applicator in the direction of bringing them closer to one another. To do this, this member may if necessary comprise a funnel. A restriction element may if necessary be provided to make the positioning of the applicator in the funnel easier.

The applicator may extend from the supporting member. The supporting member may then define a member for gripping the applicator for the purpose of handling it for the application of product. It may also define a cap capable of at least partly, and if necessary totally, closing off a delivery opening of a receptacle.

As a variant, the applicator may therefore be fitted into said supporting member. In this case, the supporting member may fully or partly house the applicator while allowing the user to extract it by the use of a gripping member. In this case, the applicator may as such serve as a cap designed to close off the delivery opening of the receptacle. The applicator may be able to be removed from the supporting member. The applicator may be moved independently of the supporting member from a mounted position in said supporting member to a position of extraction from this member.

The supporting member surrounds the applicator over a portion of its height. This supporting member may be a sheath receiving the applicator in a removable manner, a stem supporting the applicator, a gripping member used for the purpose of applying product and, if necessary, a cap designed to close off a delivery opening of a receptacle.

The irregularities of the tube may extend to an intermediate height between a reserve of product and an opening for mounting the supporting member. In particular, they may be provided between a grid for delivering product and an opening for mounting the supporting member.

The tube may be secured to a receptacle. It may be permanently mounted on this receptacle, in a reversible manner or be produced in a single piece with this receptacle. This tube may surround or receive the applicator over at least a portion of its height. It may if necessary also surround the supporting member over at least a portion of its height. As a variant, the supporting member may surround the tube over at least a portion of its height.

The applicator may be secured in movement to the supporting member during a movement of the base relative to the tube between a low position and a high position.

Said sliding path may comprise a ramp. This ramp may define a cam. The relief provided on the supporting member may form a cam surface suitable for sliding over this cam, or vice versa. A rotation of the supporting member may then cause its axial movement, along the axis of the tube. This movement may result in a raising of the supporting member relative to the tube.

This ramp may wholly or partly comprise said plurality of irregularities. This plurality of irregularities may if necessary be arranged in a stepped manner. This ramp may comprise at least one flat. The upstream portion of this flat and the downstream portion of this flat may allow jumps of different amplitude. A flat may therefore extend between two ramps of identical or different inclination. These ramps may have irregularities having a respective identical or distinct pitch. This flat may extend between two ramps defining a respective slope oriented in one and the same direction or in a different direction.

The plurality of irregularities may be partly, and in particular mainly or even exclusively, provided on a ramp, along said sliding path. The presence of said plurality of irregularities at this level makes it possible to ensure that, once the applicator is impregnated with product in the low position of the base, the applicator may be brought to its high position while being wrung out and being moved away from the reserve of product so that the product surplus that is got rid of thanks to the irregularities is prevented from being immediately picked up again if the user continues to move the base to its high position. The product thus released may, for its part, fall back by gravity directly into the receptacle, or, if necessary, onto a delivery grid overhanging a receptacle.

In a general manner, said sliding path may comprise an insertion passageway (if necessary also forming an extraction passageway) for said relief comprising a ramp or a groove that is vertical relative to a lengthwise axis of the tube. This groove may comprise two lateral edges converging on one another. This groove may therefore define a reduction in which said relief of the supporting member of the base is engaged and guided. In other words, this groove may comprise two lateral walls flaring out towards the top.

The sliding path may comprise two sectors of sliding path of the supporting member extending in at least two distinct general directions, or profiles. For example, one may be provided in the form of a ramp, if necessary helical, the other in the form of a substantially horizontal portion.

Said sliding path may comprise a first sector suitable for directing the applicator in the direction of the product, and a second sector suitable for keeping the applicator close to, or even in contact with, the product.

Said supporting member may be mounted removably on said tube by a bayonet system.

The supporting member may if necessary be snap-fitted onto the tube while being allowed to be rotated relative to this tube.

The first sector of sliding path may define a passageway or corridor for insertion of the base. In particular, it may define a passageway for insertion of the supporting member, in particular for the lug of this supporting member. Such a passageway may if necessary also be used for its extraction. In other words, this first sector may also serve as a passageway for taking out the base when the supporting member is moved from its low position to its high position.

The first sector of sliding path may comprise a ramp. This ramp may be oblique or have a helical profile. As a variant, this first sector may comprise a groove or slot that is vertical or axial. This first sector may also be provided with said plurality of reliefs. This first sector may bring the base from a high, if necessary separated, position to a low position. It may if necessary guide its movement from its high position to its low position. The first sector may therefore make it possible to orient the applicator towards the product to be taken for the purpose of its impregnation.

The first sector of sliding path may lead to a second sector of sliding path. This second sector may comprise a flat or horizontal sliding edge, or a ramp with a slope distinct from that defined by said first sector, for example with a lesser slope. The slopes defined by the first and second sector may if necessary be spaced apart by a flat.

The second sector may orient or retain this base in the low position, by axially retaining said base so as to facilitate the taking of product, if necessary by frictional contact of the applicator on a delivery grid of a receptacle. This second sector may if necessary comprise less than five reliefs, if necessary less than three reliefs, particularly a single relief, or it may even have no relief.

This second sector may comprise reversible means for attaching the supporting member to the tube. To do this, the lug may if necessary interact with a protuberance or a rice grain provided on the tube for the purpose of holding the base in place on this tube.

The sliding path may if necessary comprise a third sector. The second sector may connect said first and third sectors together.

This third sector may be used for the movement of the base from its low position to its high, if necessary separated, position. This third sector may comprise a vertical or axial groove or a ramp. This ramp may have a slope opposite to that of the first sector.

This third sector may, if necessary, be provided with said plurality of reliefs. In other words, only the first sector, only the second sector, only the third sector, only the first and third sectors, only the second and third sectors, only the first and second sectors, or the first, second and third sectors may comprise a plurality of irregularities.

As a variant, as mentioned above, the first sector may perform the function of this third sector. The first sector may therefore be used both for the sinking of the base on the tube and for the raising of this base relative to said tube. In such a case, the base may be made to travel back and forth relative to the tube in order to travel from a high position to a low position and then from this low position to said high position.

These sliding sectors may extend over at least two planes intersecting one another. These planes may be transverse, parallel or oblique to the axis of the tube. In particular, the first sector may extend on a plane that is oblique or parallel to the axis of the tube or a generatrix of this tube. The second sector may extend in a direction that is oblique or transverse to the axis of the tube or a generatrix of this tube.

The tube may comprise at least two distinct sliding paths each provided with said plurality of irregularities, the supporting member comprising a respective relief capable of sliding on their respective sliding path. These sliding paths are, in this case, separated from one another.

Said sliding paths may be symmetrically opposed to one another. They may, for example, be provided diametrically opposed on the tube. These sliding paths may, if necessary, extend symmetrically relative to an axis of the tube, said supporting member comprising two reliefs each adapted to interact with one of said sliding paths. This axis of the tube may be an axis of revolution or an axis diametrically intersecting this tube.

Said sliding path may be at least partly made in a single piece with said tube. In other words, this sliding path may be made out of the tube.

As a variant, this sliding path may be formed by a part fitted onto or into the tube. This sliding path may form a guide groove or a crank.

Said sliding path may extend at least partly inside said tube. For example, this sliding path may protrude radially inside said tube. In this case, said sliding path may form an inner extra thickness of said tube. Conversely, it may be provided in the thickness of said tube. This sliding path may comprise a guide groove defining linear, circular or curvilinear path sectors.

The device may also comprise a positioning member suitable for defining the level of relative sinking of the supporting member relative to the tube. This positioning member may comprise return means, a rigid insert fitted into said tube, or a sliding edge of the base made, if necessary, in one piece with said tube.

The return means may comprise a coil spring. The supporting member may be pressed elastically against the sliding path by these return means. The supporting member may comprise at least one snap-fitting notch capable of being inserted beneath the sliding path of the tube. This notch may press against said return means so as to act on the movement of the base from its low position to its high position. In the low position of the base, the return means are therefore in the compressed state. The return means may adopt a progressive relaxed state gradually as the supporting member moves from its low position to its high position. These progressive relaxed states may result from the successive meshing of the relief(s) of the base against the irregularities of the base.

The guide groove may be formed together by the insert and the tube. Therefore, the insert and the tube may define a respective sliding edge facing one another suitable for guiding the movement of the lug of the supporting member. The insert may be interposed in an immobilized manner between the tube and a receptacle of product. More precisely, this groove may be formed by the assembly of two parts one in, or on, the other. Such a groove then extends between these assembled parts. This groove may again define a plurality of sliding-path sectors of the supporting member relative to the tube.

The sliding edge may comprise a bottom edge of a guide groove or a crank. The guide groove may be formed out of the tube. This groove may therefore be made of the same material as the tube. It may be made in the thickness of this tube. This tube may surmount a receptacle and in particular may define a receptacle neck. Such a tube may, if necessary, be made in a single piece with said receptacle.

The tube may comprise a cylindrical surface defining a sliding path.

The sliding path may extend at least partly helically about the axis of the tube. This helix may comprise, if necessary, a number of turns that is less than or equal to one.

The sliding path may guide in rotation the supporting member over a circular sector of less than or equal to 360°, particularly less than or equal to 180°. The supporting member may then be extracted from the tube by being moved a complete revolution or less, even a half-revolution or less.

As a variant, this sliding path may guide in translation the supporting member relative to the tube.

A further subject of the present invention is a packaging and application assembly comprising a device as defined above and a product receptacle containing a reserve of said product.

The receptacle may comprise an opening for delivery of product and an opposite bottom wall. This receptacle may comprise a lateral wall comprising, on the one hand, a delivery opening, if necessary provided on a delivery neck, and, on the other hand, a bottom wall configured to rest on a resting surface such as a shelf. This bottom wall may, in a situation of normal use of the packaging assembly, be immobile relative to said lateral wall. If necessary, the bottom wall and the lateral wall may be made in a single piece.

The lateral wall may, if necessary, be compressible so that a compression applied substantially perpendicularly to their lengthwise axis may cause an excess pressure within the receptacle that is capable of moving the product at least partly in the direction of the delivery opening. This receptacle may have no piston. In particular, this receptacle may have no piston mounted in frictional contact against an inner surface of the lateral wall of the receptacle, suitable for pushing the product in the direction of a delivery opening. If necessary, the receptacle may have a constant volume.

The tube may define such a product receptacle.

The tube may be secured to a product receptacle. This receptacle may therefore be fixedly linked to the tube. It may therefore be reversibly linked to this receptacle. In this case, the tube may comprise attachment means capable of interacting with complementary means provided on the product receptacle, such as by snap-fitting, screwing or otherwise by tightening. The tube may be received at least partly in the receptacle, on the receptacle or around the receptacle.

As a variant, the tube may be made in one piece with said receptacle, including being made in a single piece, overmoulded or bi-injected.

This assembly may if necessary comprise a product delivery grid provided with a plurality of delivery orifices. This grid may be fitted between the tube and the receptacle. As a variant, this grid may be made in a single piece with the receptacle or be made in a single piece with the tube or be made in a single piece with a positioning member fitted to the receptacle or else be made in one piece with the receptacle-tube assembly, including being made in a single piece, overmoulded or bi-injected.

A further subject of the present invention is an application device comprising:

a base comprising:

- an applicator configured to spread a cosmetic product on a bodily application surface, this applicator being chosen from a foam, a porous material, a rough material, a powder puff provided with a tuft of bristles, a woven, a non-woven or a felt,
- a member for supporting the applicator comprising at least one relief, a tube capable of surrounding the applicator, said base being able to be moved relative to the tube between a high position and a low position, said tube comprising a path for the sliding of the supporting member comprising a plurality of irregularities against which said at least one relief of the supporting member is able to slide so as to create a jump of the applicator.

A further subject of the present invention is an application device comprising:

a base comprising:

an applicator configured to spread a cosmetic product on a bodily application surface, a member for supporting the applicator comprising at least one relief, a tube capable of surrounding the applicator, said base being able to be moved relative to the tube between a high position and a low position, said tube defining a path for the sliding of the supporting member comprising a plurality of irregularities against which said at least one relief of the supporting member is able to slide so as to create a jump of the applicator, this sliding path being able to comprise two sectors of sliding path of the supporting member extending in at least two distinct general directions or profiles.

A further subject of the present invention according to another aspect is an assembly for the packaging and the application of a cosmetic product on a bodily application surface comprising:

a receptacle suitable for containing a reserve of the cosmetic product in the form of powder, a base comprising:

an applicator configured to spread said cosmetic product on said bodily application surface, a member for supporting the applicator comprising at least one relief, a tube capable of surrounding the applicator, said base being able to be moved relative to the tube between a high position and a low position, said tube comprising a path for the sliding of the supporting member comprising a plurality of irregularities against which said at least one relief of the supporting member is able to slide so as to create a jump of the applicator for the purpose of releasing a surplus of powder impregnated by this applicator.

A further subject of the present invention, according to another aspect, is an assembly for the packaging and application of a cosmetic product on a bodily application surface comprising:

a receptacle suitable for containing a reserve of the cosmetic product, said receptacle comprising a lateral wall comprising, on the one hand, at least one delivery opening through which the product is delivered and being closed off, on the other hand, by a bottom, said bottom being immobile in the normal situation of use relative to at least a portion of said lateral wall, a base comprising:

an applicator configured to spread said cosmetic product on said bodily application surface, a member for supporting the applicator comprising at least one relief, a tube capable of surrounding the applicator, said base being able to be moved relative to the tube between a high position and a low position, said tube comprising a path for the sliding of the supporting member comprising a plurality of irregularities against which said at least one relief of the supporting member is able to slide so as to create a jump of the applicator for the purpose of releasing a surplus of powder impregnated by this applicator.

A further subject of the present invention, according to another aspect, is a method for applying a cosmetic or care product using a device as defined above comprising the steps:

of providing a base comprising an applicator associated with or secured to a supporting member, of providing a tube comprising a sliding path for the supporting member, said sliding path comprising a plurality of irregularities, of mounting the base on the tube, of moving the base to a low position relative to said tube along the sliding path, of shaking or turning over the product receptacle so as to impregnate the applicator with product, of moving the base from its low position to a high position relative to said tube so that said supporting member slides over said plurality of irregularities so as to create a jerky movement of the applicator capable of releasing a surplus of product impregnated on the applicator, of placing the applicator in contact with a bodily surface for the purpose of applying the product impregnated on the applicator.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the peferred embodiments discussed herein are provided as examples and are not to be construed as limiting, particular since embodiments can be formed to practice the invention that do not include each of the features of the disclosed examples.

BRIEF DESCRIPTION OF THE DRAWINGS

A better understanding of the invention will be gained from reading the following description in conjunction with the accompanying figures. The figures are offered purely as a guide and by way of example, and in no way limit the invention.

The present invention also relates to the use of an application device as defined above for applying a cosmetic product.

Figure 1:
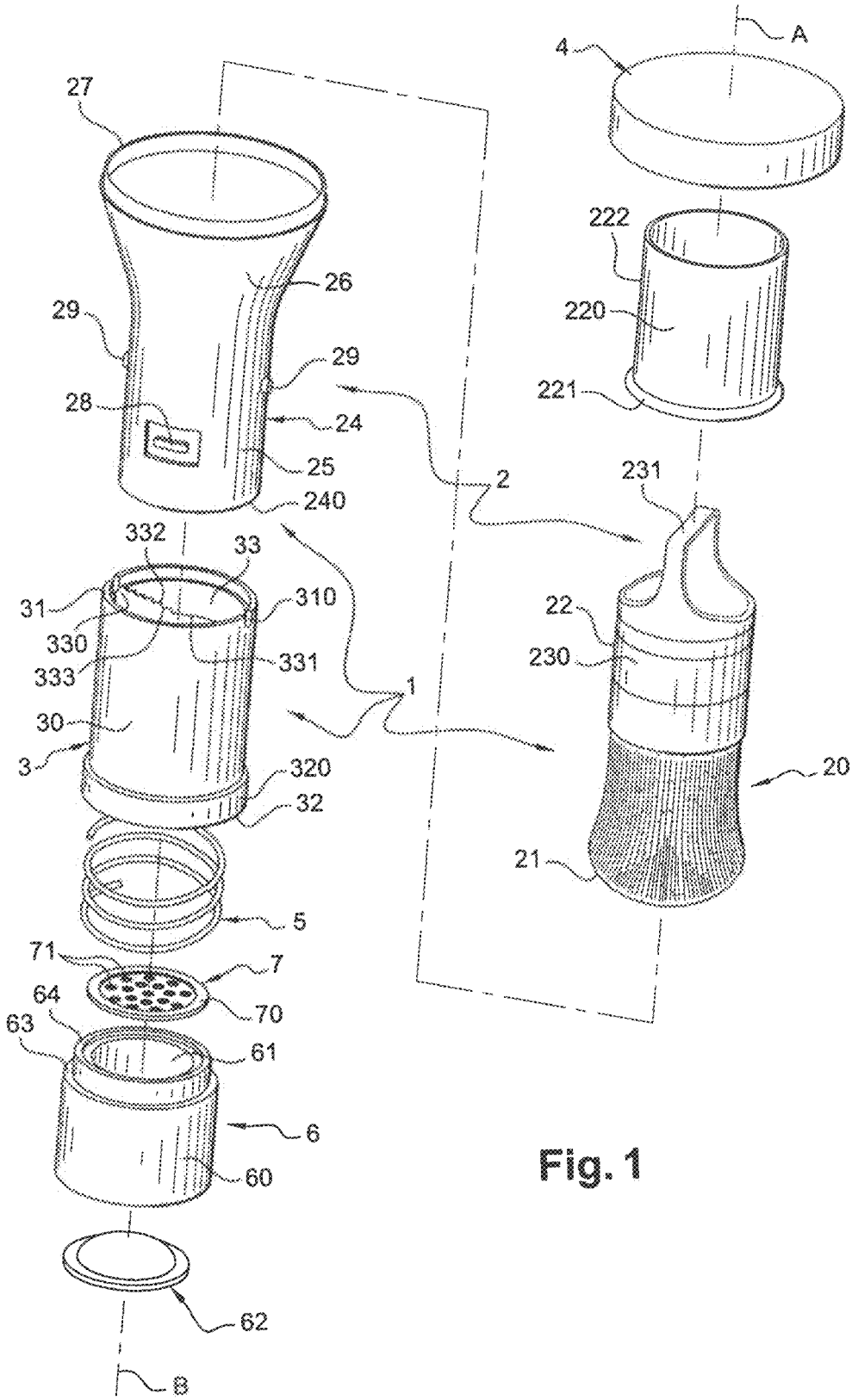
Figure 2:
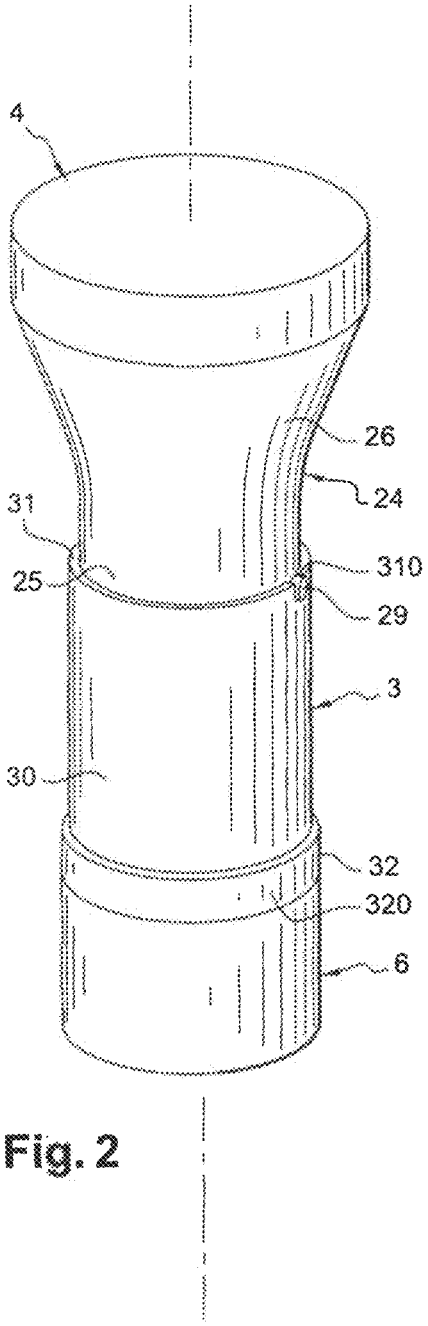
Figure 3:
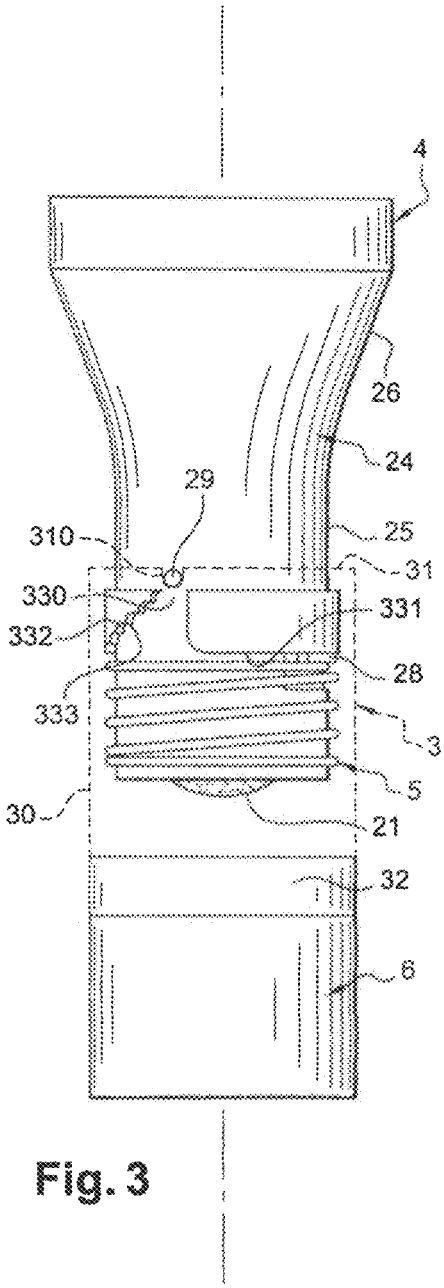
Figure 4:
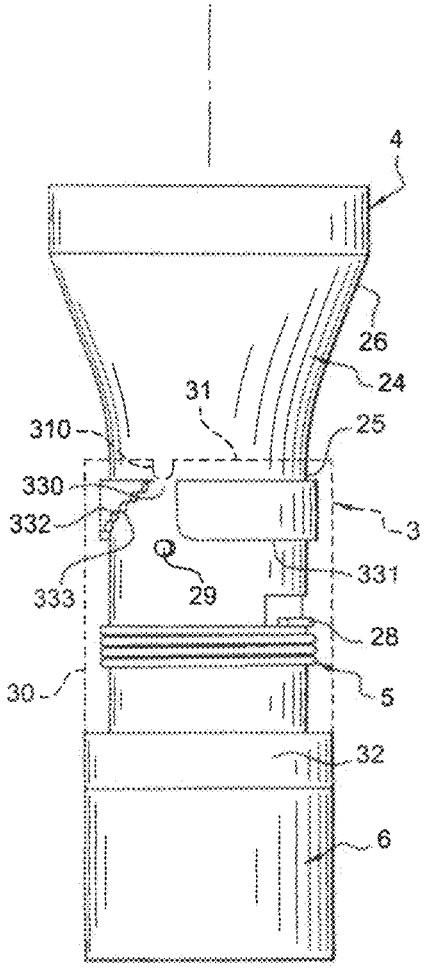
Figure 5:
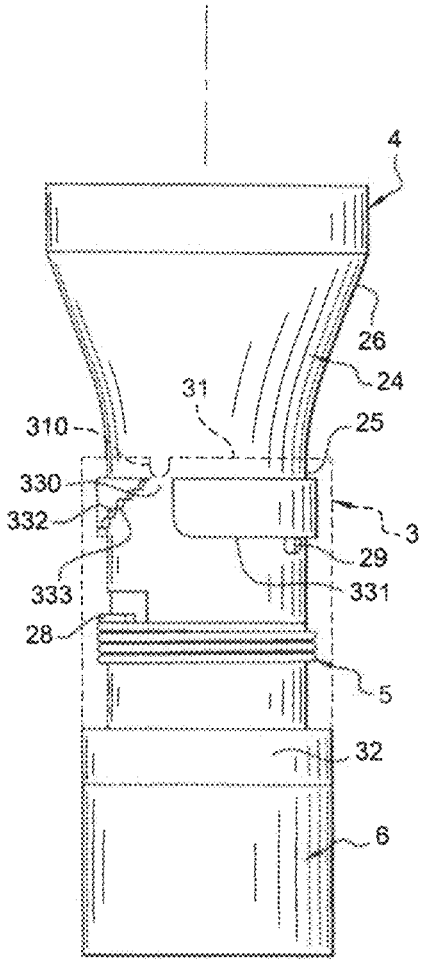
Figure 6:
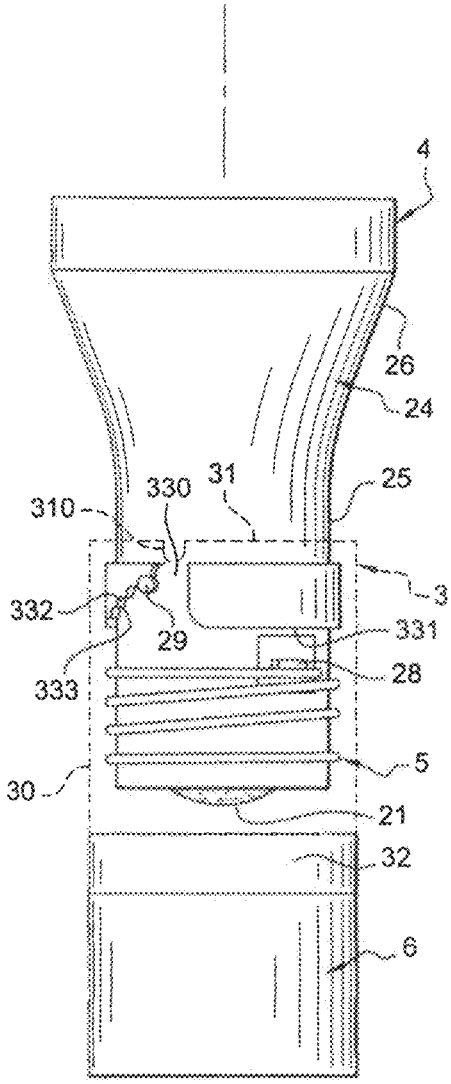
Figure 7:
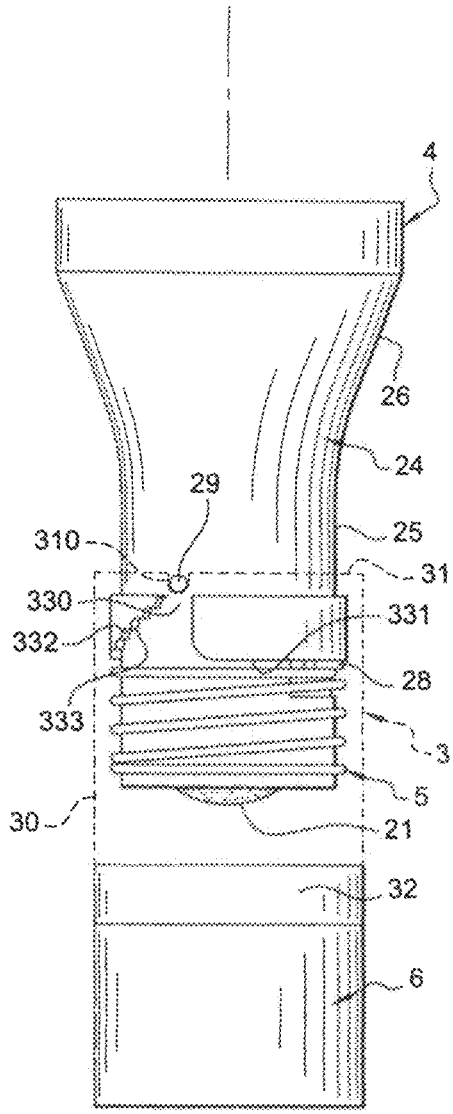

The invention may be better understood on reading the following detailed description, made with reference to the accompanying drawings illustrating a non-limiting embodiment of the latter, and in which:

FIG. 1 is an exploded view in perspective of a first embodiment of a packaging and application assembly according to the invention, FIG. 2 is an assembled view in perspective of the assembly shown in FIG. 1, FIG. 3 is a partially truncated view in perspective of the assembly shown in FIG. 2 in a first position of assembly, FIG. 4 is a partially truncated view in perspective of the assembly shown in FIG. 2 in a second position of assembly, FIG. 5 is a partially truncated view in perspective of the assembly shown in FIG. 2 in a third position of assembly, FIG. 6 is a partially truncated view in perspective of the assembly shown in FIG. 2 in a fourth position of assembly, FIG. 7 is a partically truncated view in perspective of the assembly shown in FIG. 2.

Figure 8:
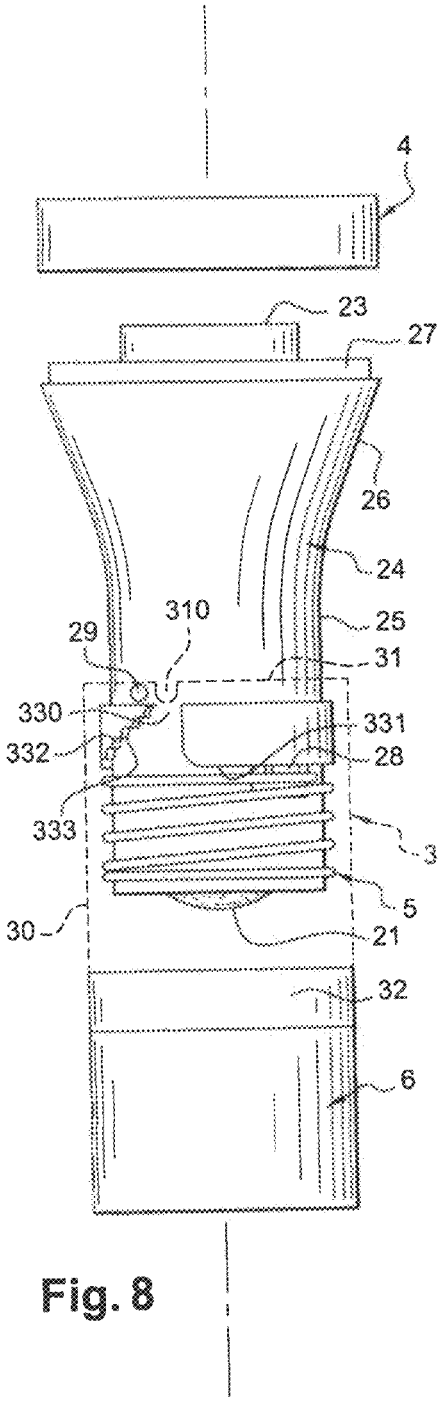
Figure 9:
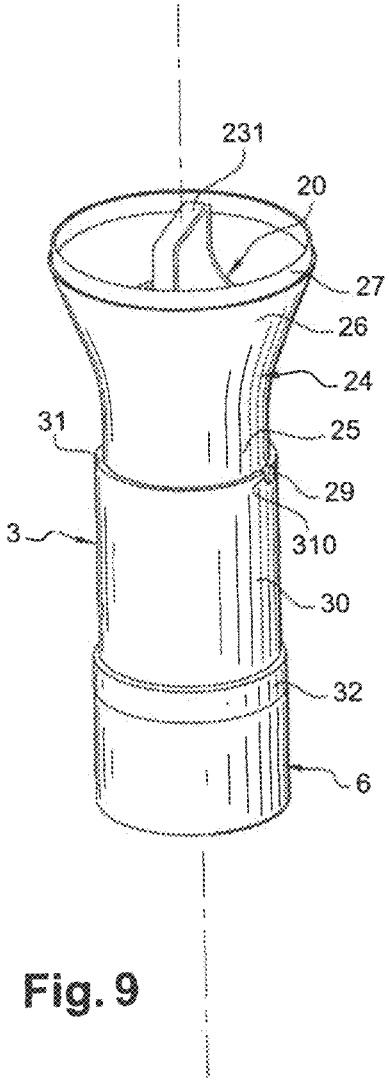
Figure 11:
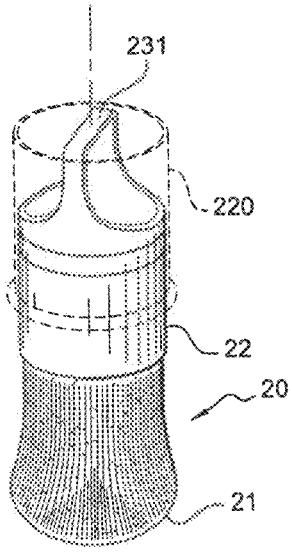
Figure 11:
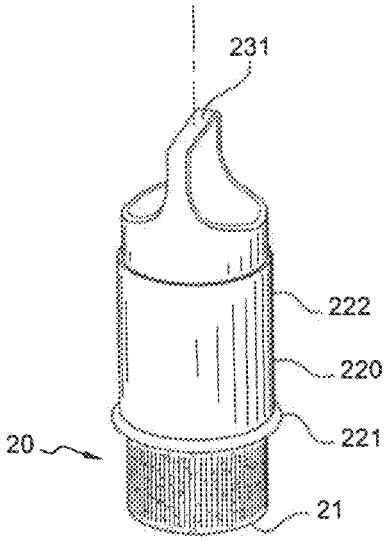
Figure 10:
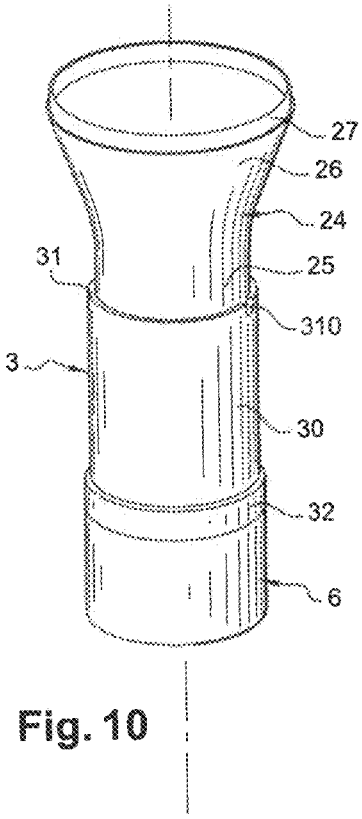
Figure 12:
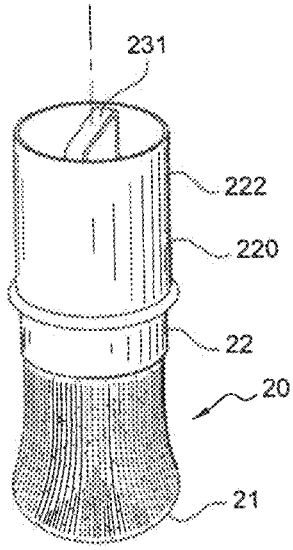
Figure 13:
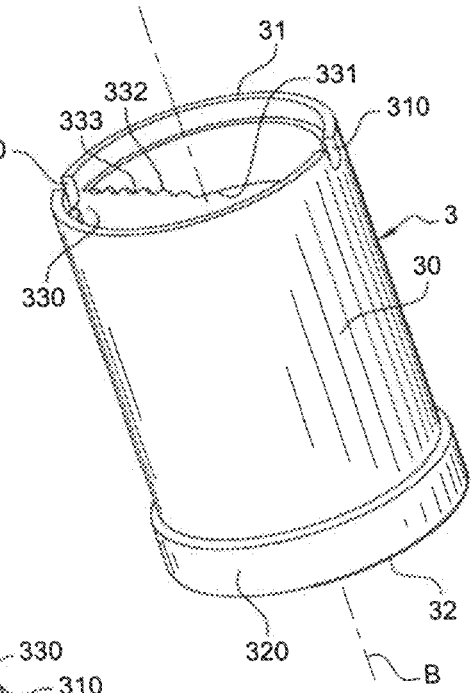
Figure 14:
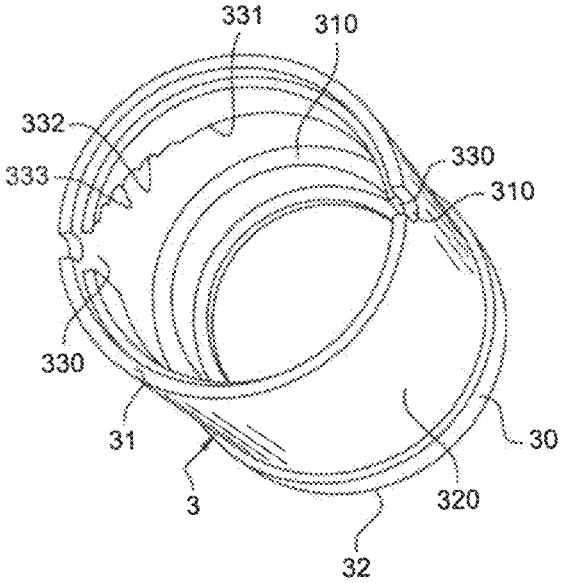
Figure 15:
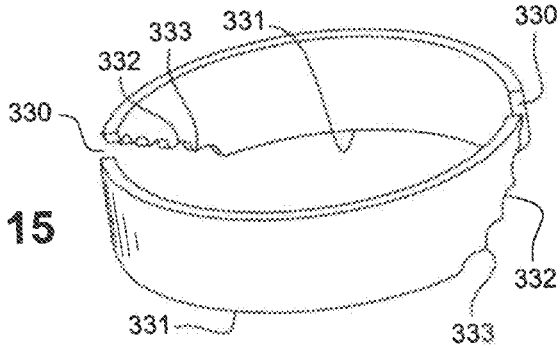
Figure 16:
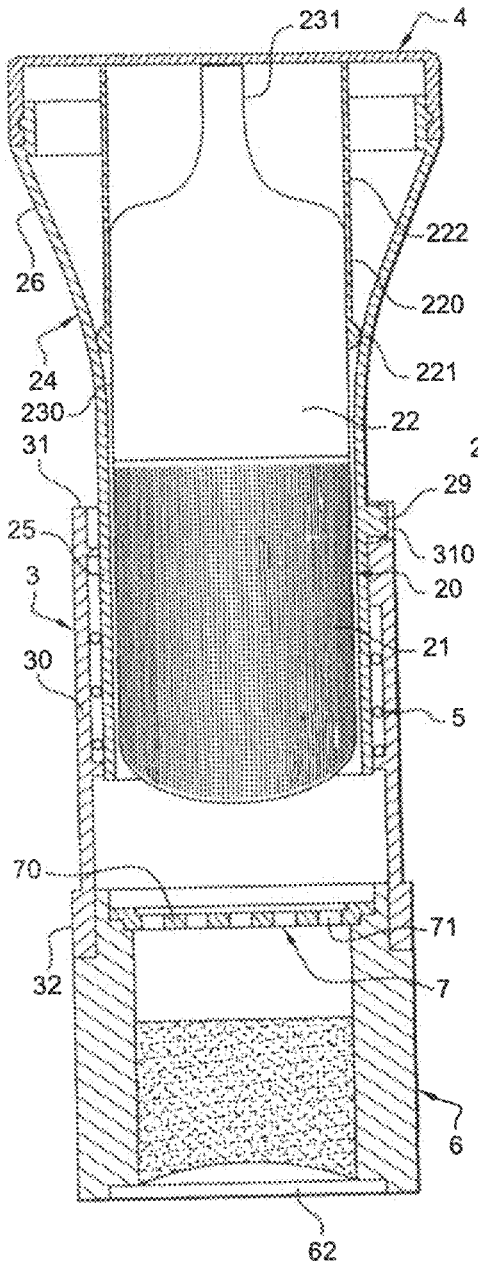
Figure 17:
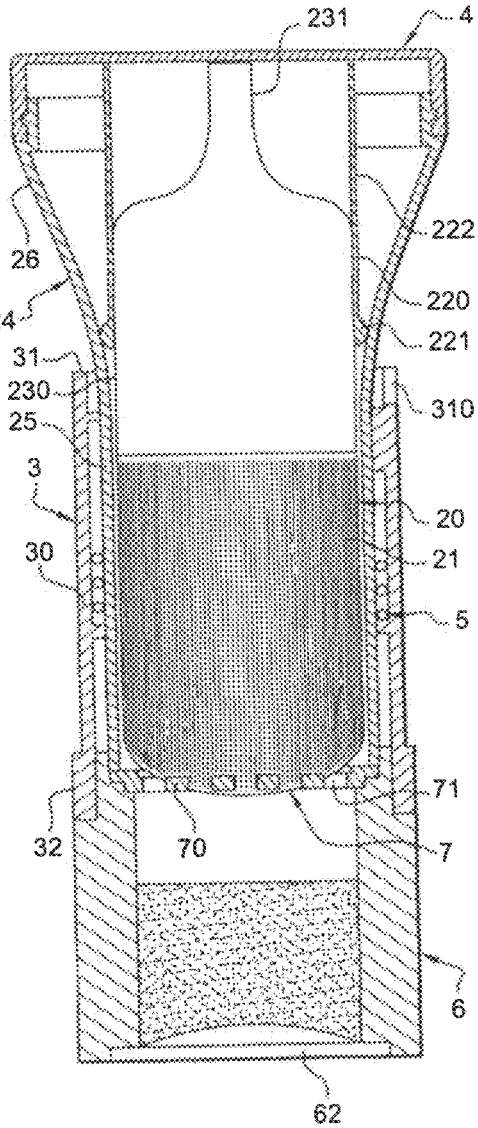
Figure 18:
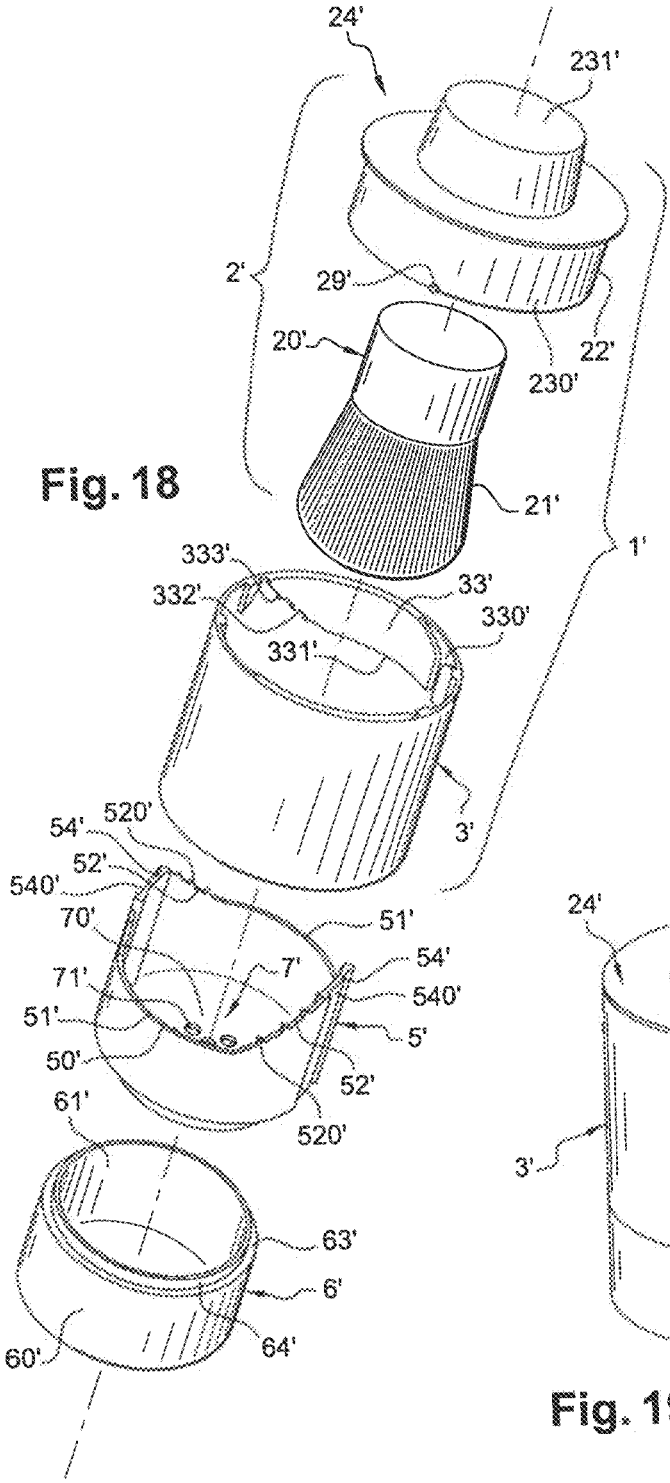
Figure 19:
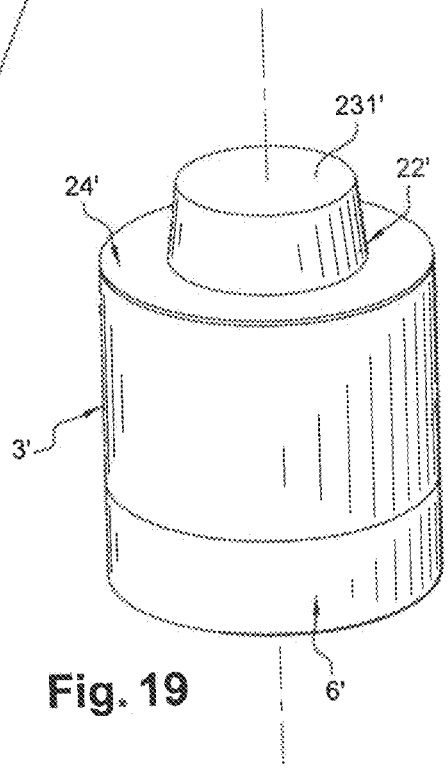
Figure 22:
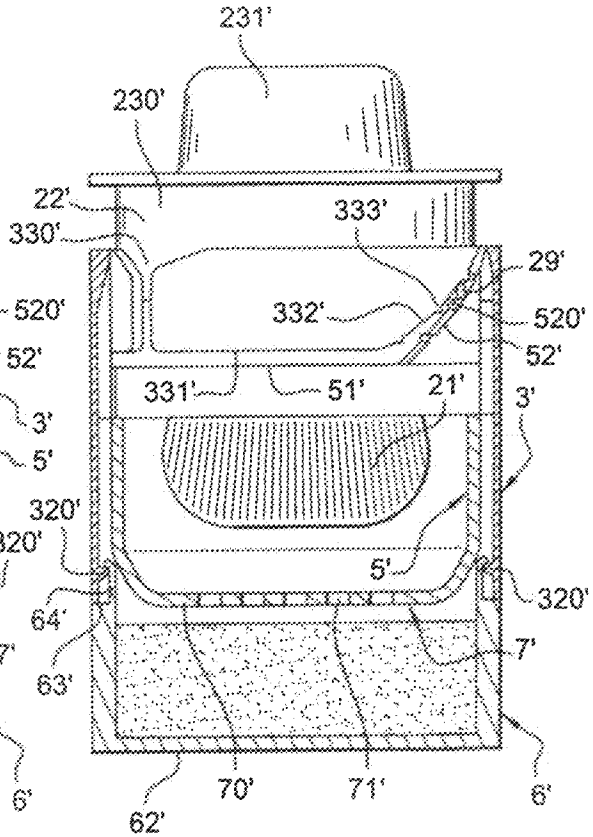
Figure 21:
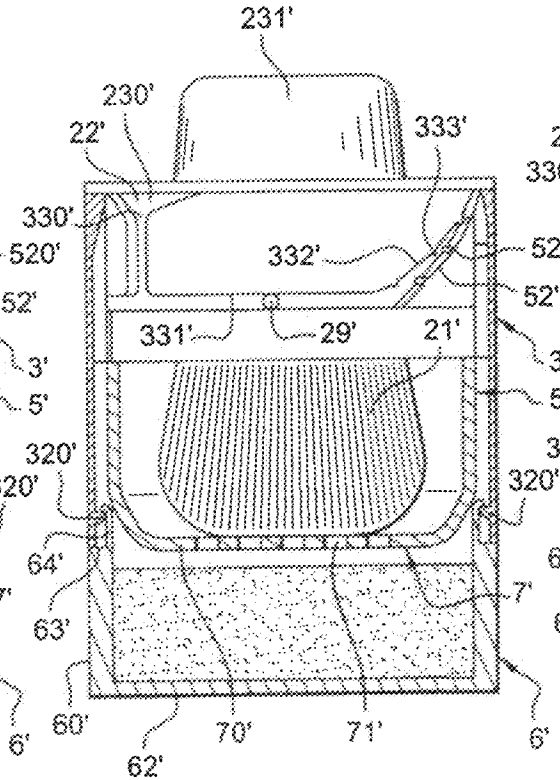
Figure 20:
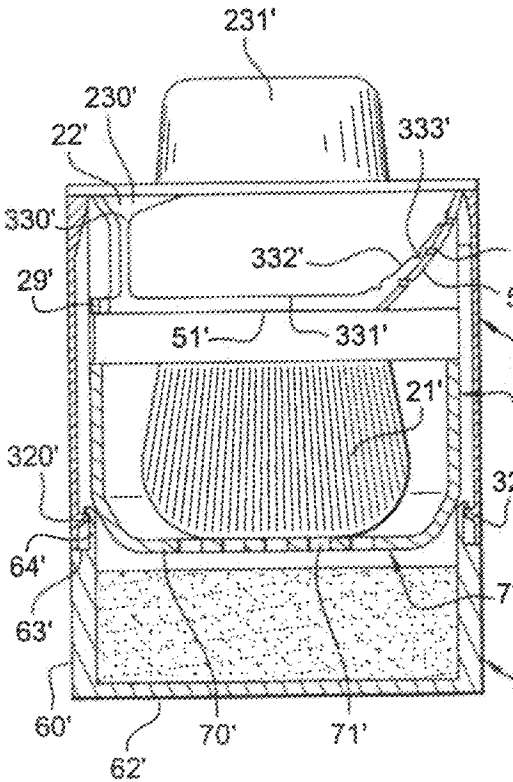
Figure 23:
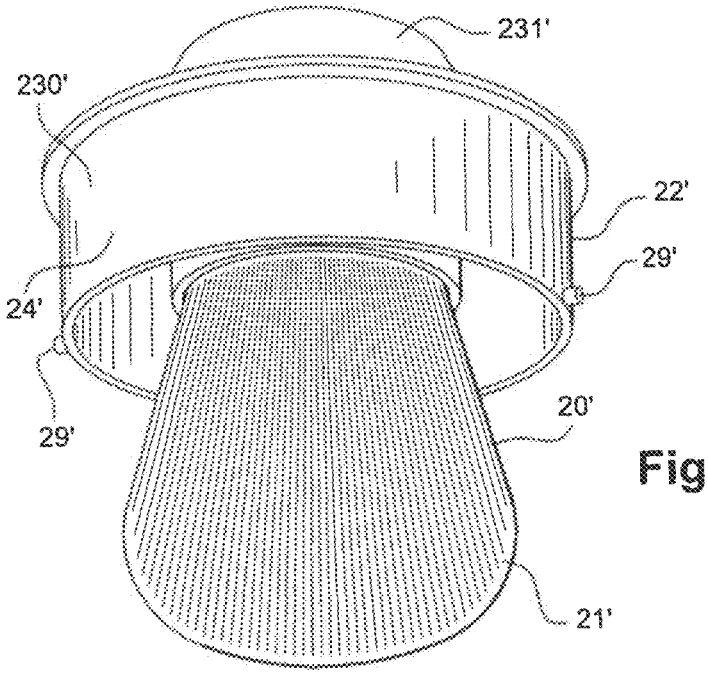
Figure 24:
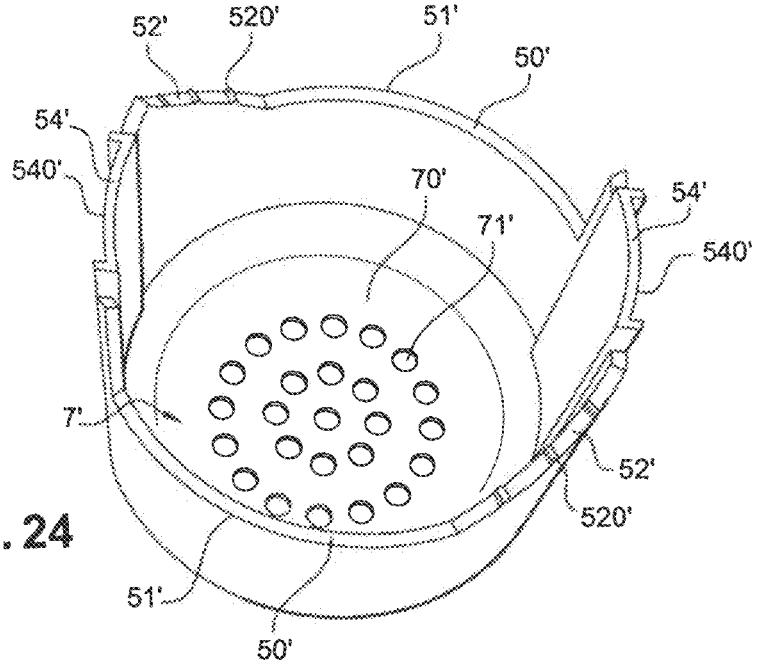
Figure 25:
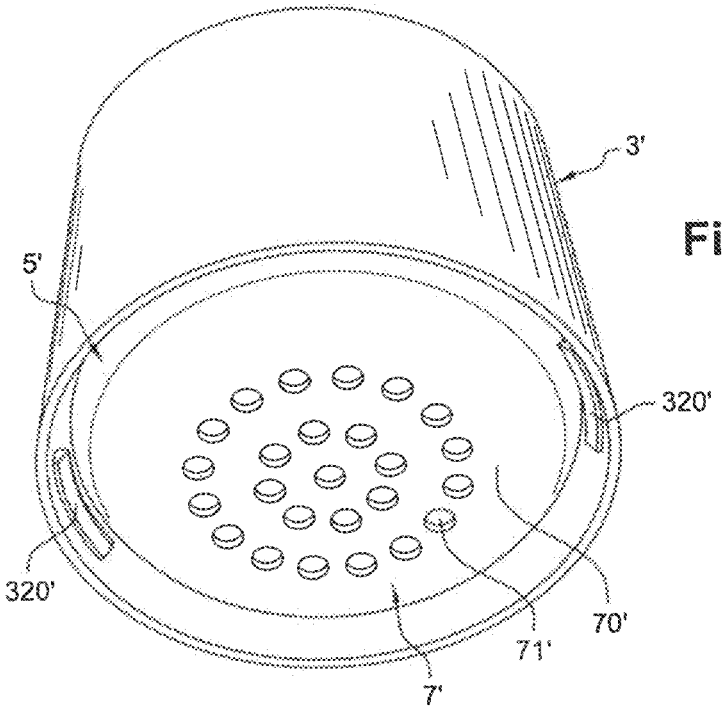
Figure 26:
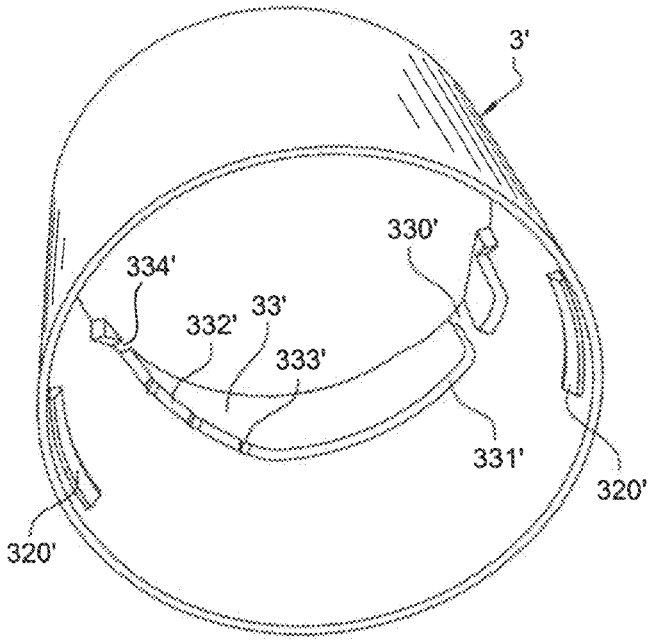
Figure 27:
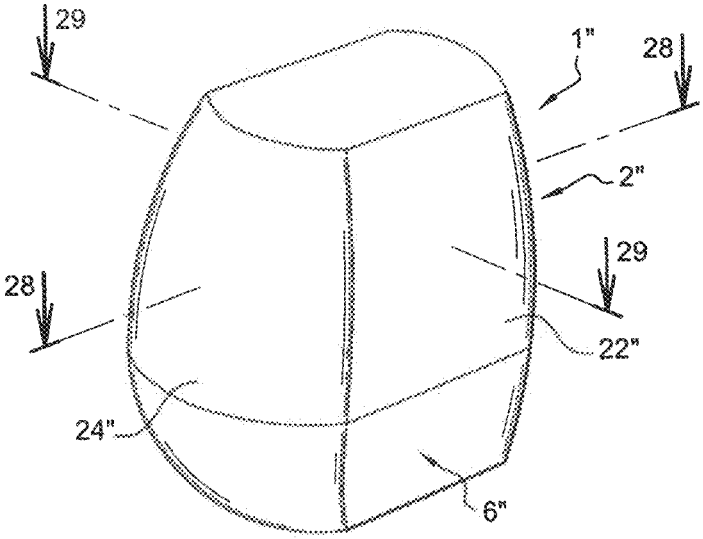
Figure 28:
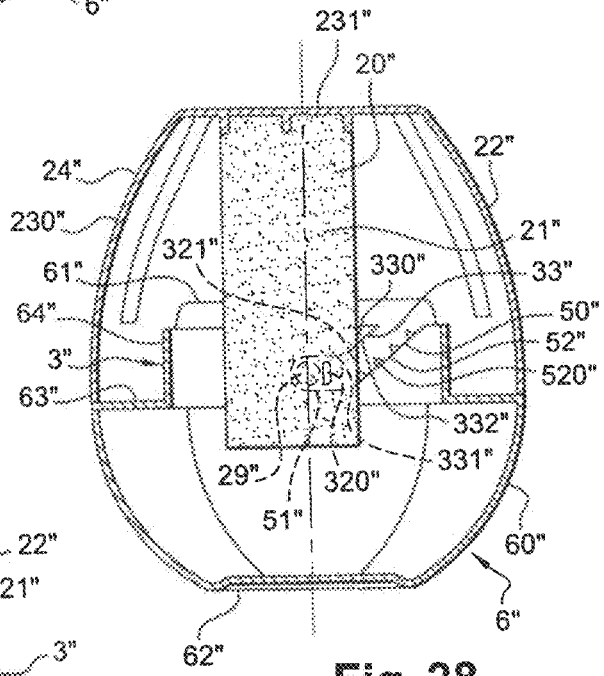
Figure 29:
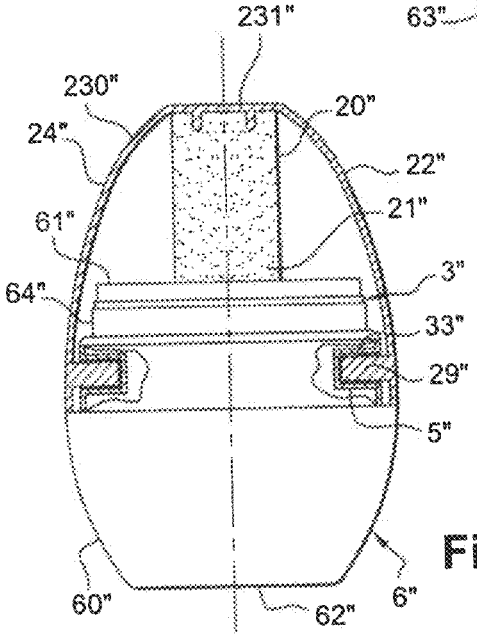
Figure 30:
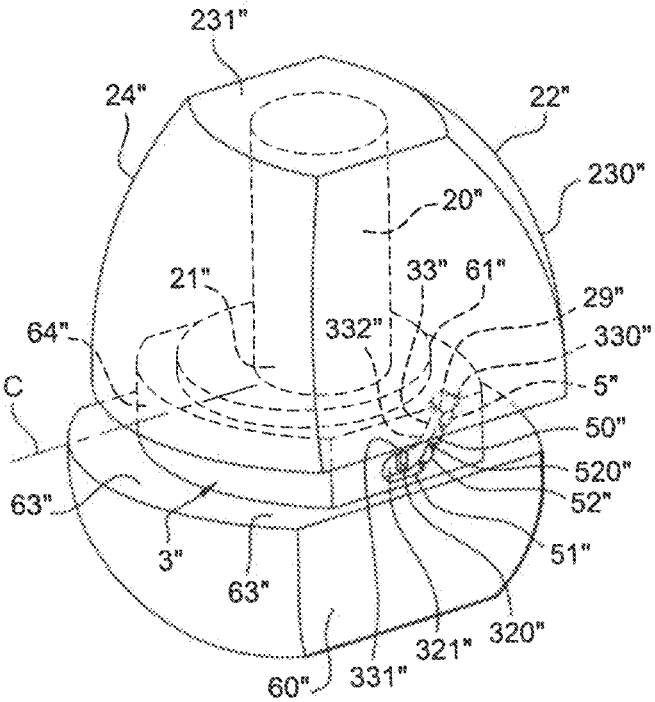
Figure 31:
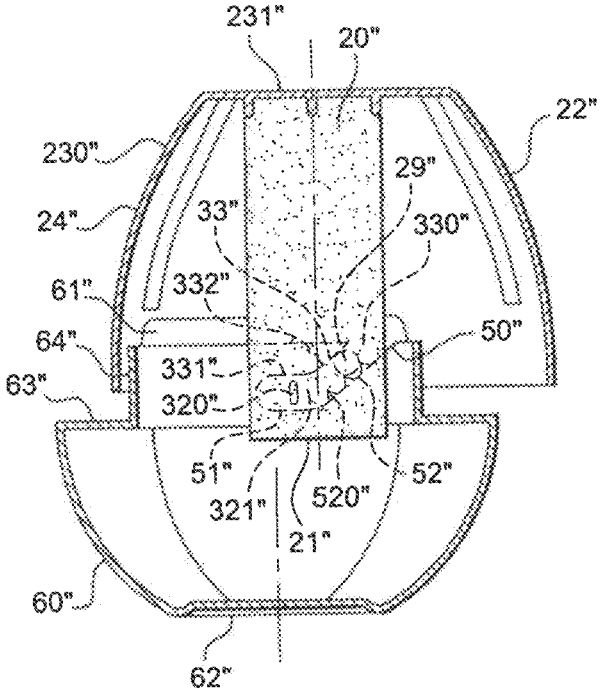
Figure 32:
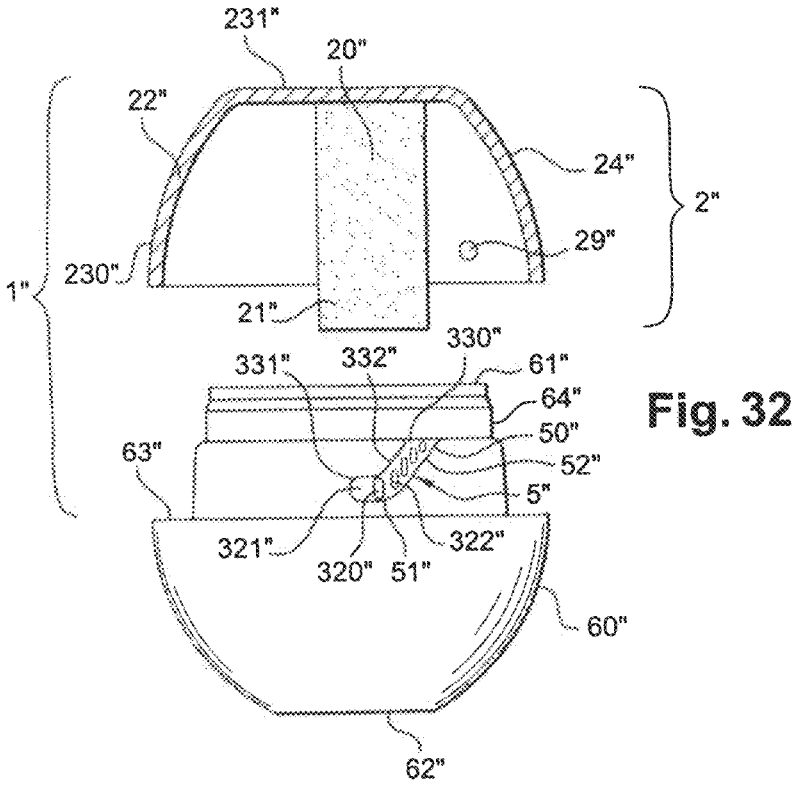
Figure 33:
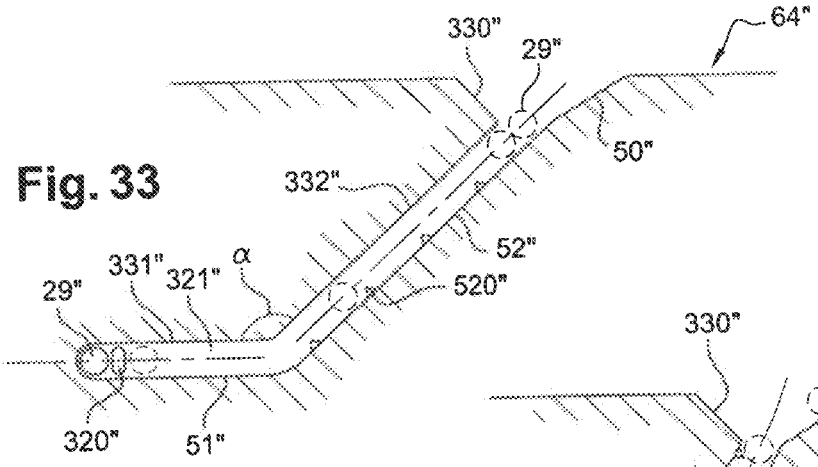
Figure 34:
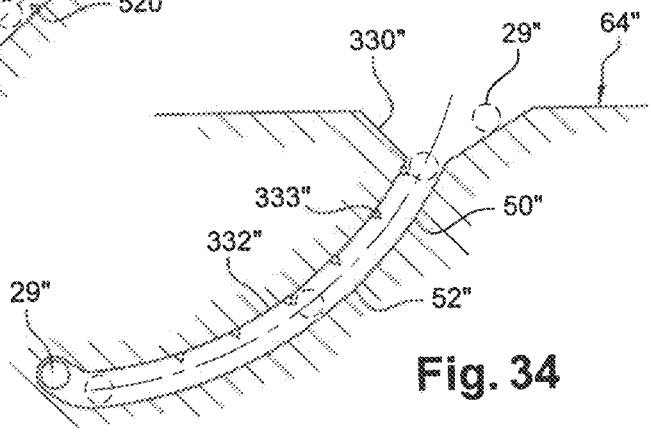

FIG. 8 is a partially truncated view in perspective of the assembly shown in FIG. 2 in a fifth position of assembly, FIG. 9 is a top view in perspective of the assembly shown in FIG. 2 after removal of a protective overcapsule, FIG. 10 is a view in perspective of the assembly shown in FIG. 9 after removal of an applicator, FIG. 11 is a view in perspective showing in isolation a particular embodiment of a base of FIG. 2 supporting an applicator in a first position, FIG. 12 is a view identical to FIG. 11 showing said base in a second position, FIG. 13 is a side view in slight elevation showing in isolation a portion of the assembly shown in FIG. 2, FIG. 14 is a top view of the portion of the assembly shown in FIG. 13, FIG. 15 is a view identical to FIG. 13 in perspective from above of an isolated portion of the portion of the assembly shown in this FIG. 13, FIG. 16 is a partially truncated view in perspective of the assembly shown in FIG. 2 in a first position of assembly, FIG. 17 is a view identical to the figure in FIG. 16 in a second position of assembly of said assembly, FIG. 18 is an exploded view in perspective of a second embodiment of a packaging and application assembly according to the invention, FIG. 19 is a side view in perspective in slight elevation of the assembly shown in FIG. 18 in the assembled position, FIG. 20 is a partially truncated view in perspective of the assembly shown in FIG. 19 in a first position of assembly, FIG. 21 is a partially truncated view in perspective of the assembly shown in FIG. 19 in a second position of assembly, FIG. 22 is a partially truncated view in perspective of the assembly shown in FIG. 19 in a third position of assembly, FIG. 23 is a view in perspective of a portion of the assembly shown in FIG. 18, FIG. 24 is a top view in perspective of another portion of the assembly shown in FIG. 18, FIG. 25 is a bottom view in perspective of the portion of the assembly shown in FIG. 24, FIG. 26 is a bottom view in perspective of another element of the assembly shown in FIG. 18, FIG. 27 is a view in perspective of a third embodiment of a packaging and application assembly according to the invention, FIG. 28 is a view in longitudinal section on the axis 28-28 of the assembly shown in FIG. 27, FIG. 29 is a view in longitudinal section on the axis 29-29 of the assembly shown in FIG. 27, FIG. 30 is a partially ghosted view in perspective of the assembly shown in FIG. 27 in a position before assembly, FIG. 31 is a view in longitudinal section identical to FIG. 28 of the assembly being assembled, FIG. 32 is a view in perspective of a first portion and in longitudinal section of a second portion in the disassembled position, FIG. 33 is a schematic view in perspective of an isolated portion of the assembly shown in FIG. 28, FIG. 34 is a schematic view in perspective of a variant of the isolated portion shown in FIG. 33.

DETAILED DESCRIPTION OF THE PREFERRED EMBODIMENTS

Referring now to the drawings, like reference numerals are utilized to designate identical or corresponding parts throughout the several views.

FIG. 1 shows a first embodiment of a packaging and application assembly according to the invention.

Such an assembly may comprise, on the one hand, an application device 1 and, on the other hand, a receptacle 6.

The application device according to the invention comprises a base 2 and a tube 3.

The base 2 comprises an applicator 20 and a supporting member 24.

The applicator 20 comprises application means 21 configured for spreading a cosmetic product on a bodily application surface, such as the face or keratinous fibres.

This applicator 20 may, for example, be chosen from a sponge, a powder puff or a shaving brush. In particular, the application means 21 may comprise a compressible foam, if necessary capable of being impregnated with product, bristles of synthetic or animal origin. These application means may if necessary be covered with flocking.

The application means 21 are secured to a gripping member 22. This gripping member may comprise a sleeve 230 surmounted by a summit portion 231. This summit portion may comprise a hoop.

The application means 21 may be fitted and attached directly to or into this gripping member 22 by any appropriate means. As a variant, they may be fitted and attached to or into said gripping member 22 via an intermediate retaining part, by any appropriate means. Examples of such attachment means may, for example, comprise a tightening sleeve-fitting, a snap-fitting, a screwing, a bonding, a welding or other.

As a variant, these application means 21 may be made in a single piece with the gripping member 22.

As can be seen in FIGS. 1, 11 and 12, the application device may also comprise a restriction element 220 designed to reduce the spread of the application means. Such an element may be used to radially narrow these application means for the purpose of its insertion into the tube 3 as will be explained further in the rest of this description.

More precisely, the applicator 20 may be surrounded by an element 220 for restricting the application means, this element being capable of constricting the application means between a spread rest position and a narrowed constricted position. This element 220 can therefore constrict the application means 21 so as to reduce the cross section of these application means relative to a lengthwise axis A of this applicator 20.

This restriction element 220 may comprise a socket 222 capable of extending around the applicator 20. This socket may be mounted so as to be able to move about the gripping member and, if necessary, about the sleeve 230 of the gripping member 22.

The restriction element may be designed to be able to move along the axis A. This element may be able to move in translation relative to the applicator 20. Its movement may be guided relative to the sleeve 230 of the gripping member, if necessary by interaction of the groove-rib type provided along the axis A or of the thread type (not shown).

This socket 222 may comprise a free end 221 capable of butting against the application means 21. This free end may, if necessary, comprise a swelling making it easier to slide the restriction element 220 relative to the application means 21.

The supporting member 24 is, in this exemplary embodiment, generally funnel-shaped, open at its two ends. More precisely, this supporting member may comprise a cylindrical barrel 25 from which rises a frustoconical portion 26. This frustoconical portion can flare out towards a neck defining a free edge 27. This neck may if necessary comprise coupling means for an overcapsule 4.

This free edge 27 of this supporting member may define an assembly opening for the applicator 20.

The supporting member 24 may comprise on the outside two diametrically opposed reliefs or lugs 29 the function of which will be mentioned later in this description. More precisely, the barrel 25 may comprise an outer surface from which these lugs 29 protrude.

The supporting member 24 may also comprise on the outside snap-fitting means 28. These snap-fitting means may comprise two claws, if necessary diametrically opposed. These claws may be provided on a portion of lesser thickness of the supporting member so as to create a resilience effect. Here again, more precisely, the barrel 25 may comprise an outer surface from which these snap-fitting means 28 protrude.

These snap-fitting means 28 and these reliefs 29 can extend on a distinct respective plane intersecting transversely the supporting member 24 and in particular the barrel 25. These planes may be parallel with one another. In particular, the reliefs 29 may extend to a lesser height of the supporting member than the snap-fitting means relative to the free edge 27. The snap-fitting means 28 may be provided level with the reliefs 29.

The application device may if necessary be covered with an overcapsule 4 mounted by any appropriate means on the base 2 between a covering position and an extracted position. This overcapsule may in particular be mounted removably on the supporting member 24. To do this, it can, for example, be mounted by tightening sleeve-fitting, snap-fitting, screwing, bonding, welding or another method.

As a variant, this supporting member 24 may be a straight cylinder or a cylinder of revolution over its whole height. Nevertheless, an advantage will become evident in the rest of this description associated with the frustoconical shape of this supporting member.

The application device also comprises a tube or sheath 3, if necessary open at both its ends. This tube may define a longitudinal or cylindrical axis B. As will be seen below, in the assembled state of the device 1, the axes A and B can be indistinguishable. These axes may extend on a lengthwise axis of said device.

This tube may comprise a sleeve 30 comprising two opposite end portions 31, 32 respectively called top and bottom.

The end portion 31 may comprise a top free edge from which extend two notches 310 that are provided to be diametrically opposed. The function of such notches will be explained further in the rest of this description.

The end portion 32 may comprise means 320 for attachment to a product receptacle. In particular, this end portion 32 may comprise a ring 320 to be screwed, to be snap-fitted, to be crimped or to be sleeve-fitted onto a product receptacle.

The sleeve 30 may comprise an inner cylindrical surface from which reliefs or protrusions 33 extend radially. These reliefs 33 may define a sliding path for the lugs 29. In particular, these reliefs 33 may define a top sliding edge for these lugs. A single sliding path may be provided.

As a variant, as illustrated in particular in FIGS. 13, 14 and 15, these reliefs 33 may define a plurality of sliding paths, if necessary separated by passageways 330 for the through-movement of a single lug 29 or a respective lug 29. In these figures, these reliefs define two distinct sliding paths spaced from one another by passageways 330. As a variant, three or more distinct sliding paths may be provided. These sliding paths may extend symmetrically relative to the axis B of the tube 3.

These reliefs 33 may comprise, according to this example, two ring sectors comprising at least one toothed portion turned towards the end portion 32 of the sleeve, and in particular towards a receptacle 6 to be connected.

These ring sectors may define two sliding paths suitable for interacting with a respective lug 29 of the supporting member 24.

These ring sectors may define between them a respective passageway 330 for the reliefs 29 of the supporting member 24 used for the insertion of the supporting member into the tube, and even for its extraction as will be explained further in the rest of this description.

The notches 310 may extend vertically to these passageways. These passageways may comprise a substantially vertical groove, extending in the axis B of the tube, or a ramp.

This passageway 330 may define a first sliding path sector. Each ring sector may also comprise a second sliding path sector 331. It may also comprise a third sliding path sector 332. These sectors may have distinct directions or profiles.

The second sector may comprise a sliding edge 331 that is substantially circular or horizontal. This second sector may lead to the third sector. This third sector may comprise a ramp 332.

In the example shown, this ramp 332 is provided with a plurality or succession of irregularities 333. In other words, said ramp may be notched or toothed. For example, said ramp may comprise between 2 and 10 irregularities, if necessary between 3 and 6 irregularities. If necessary only this ramp is provided with said irregularities 333.

The ramp 332 may extend generally along a helical profile. The irregularities 333 may if necessary be distributed over less than one turn. For a given sector, these irregularities may for example be distributed over less than 90°, preferably less than 60°, if necessary less than 45°.

As a variant or additionally, the edge 331 may comprise one or more irregularities 333 (not shown).

More generally, one or more, or even each sliding path sector may be provided with irregularities.

Each irregularity 333 may optionally define a reinforcement. In particular, each irregularity may have a circular and particularly semicircular inner profile. As a variant, said ramp may extend along stairs provided with a plurality of steps.

The reliefs 33 hay be made in a single piece with said tube 3. As a variant, said reliefs may be fitted into said tube, and attached by any appropriate means such as by bonding or welding.

It should be noted that a sliding path may comprise a single sliding sector. This sliding sector may comprise a ramp 332 provided with said plurality of irregularities 333.

As will be understood hereinafter, in this case the insertion and the extraction of the lugs 29 is carried out via this same ramp 332 by virtue of a path in one direction, then in the reverse direction, of the lug 29 along this ramp. In this case, the lugs 29 may, in the low position of the base 2, hit a stop. This stop can be a sign for the user that product has been taken by the applicator and that he can raise the base 2 from this low position to its high position using the same path in the reverse direction.

As a variant, the sliding path of the base may comprise two sliding sectors. In this case, this sliding path may, for example, comprise a first sector comprising a ramp leading to a second sector comprising a substantially horizontal portion. As a variant, this second sector may comprise a ramp leading to a ramp with a distinct slope, for example with less of an incline. According to another variant, the first sector may comprise a vertical groove.

As will be understood hereinafter, in these cases, the insertion of the lugs 29 into the tube 3 and its extraction from this tube may again be carried out via one and the same portion, as appropriate the vertical groove or the ramp. Here again a stop defining the low position may be provided.

According to another variant, this sliding path may comprise more than three sliding sectors, comprising for example in particular ramps spaced apart by flats.

The application device 1 may also comprise a member 5 for positioning the base 2 relative to the tube 3. As will be explained more in the rest of this description, this positioning member 5 can support the supporting member. More precisely, it can limit the level of sinking relative to the base 2, and in particular of the supporting member 24, relative to the tube 3. The supporting member, and in particular the frustoconical portion 26, may also participate in limiting this sinking by butting against the end portion 31 of the tube.

This positioning member may be fitted into said tube. This positioning member 5 may comprise elastic return means.

These return means may, for example, comprise a helical spring. This spring may be mounted in the tube 3, in tight engagement around the barrel 25 of the supporting member 24.

As a variant, this positioning member 5 may be made in a single piece with the tube. In such a case, this member may comprise an annular rib extending radially inside the tube 3.

The receptacle 6 contains a reserve of cosmetic product, including care product. This cosmetic product may be a liquid product, a pasty product or a product in powder form, if necessary compacted to crumble. This product may be a foundation, a concealer, an eyeshadow, a lipstick, a lip gloss, a nail varnish or a skin care product.

This receptacle comprises a lateral wall 60 comprising, on the one hand, a delivery opening 61 and, on the other, a bottom 62. This receptacle may define an inner product-packaging space of constant, of if necessary variable, volume.

The bottom 62 may if necessary be fitted fixedly by any appropriate means to said lateral wall, for example by snap-fitting. As a variant, this bottom 62 may be made in a single piece with the lateral wall 60. This bottom may be generally immobile relative to at least one portion of the lateral wall.

The delivery opening 61 may, as necessary, be provided on a delivery neck. This neck may comprise a shoulder 63 from which a mouth 64 extends. This neck may if necessary be made in a single piece with the receptacle or be fitted fixedly into this receptacle.

The delivery opening may be covered by a delivery grid 7. This grid may comprise a membrane or plate 70 provided with a plurality of delivery orifices 71. This grid may be fitted fixedly into the receptacle 6. In particular, this grid may be mounted on the mouth 64, particularly by snap-fitting. This grid forms a sieve designed to deliver, through said delivery orifices 71, small quantities of product originating from the reserve of product contained in the receptacle 6.

In order to pass to an assembled position of the application device according to this embodiment of the invention, shown in particular in FIG. 2, the positioning member 5 is inserted into the tube 3. To do this, this positioning member can be inserted through the end portion 31 of the tube.

The positioning member 5 can be held in the tube 3 by a flange or reduction 311 extending radially inside the tube, as illustrated in FIG. 14. This flange may form an inner crank on which said spring rests. This flange may extend over a radial distance that is greater than that of the reliefs 33.

The restriction element 220 of the applicator 20 is, as necessary, engaged around the applicator. This restriction member may be mounted so as to force the application means forming the applicator to tighten against one another in order to reduce the cross section of this applicator.

The applicator 20, provided, as appropriate, with the restriction element 26, is then mounted into the supporting member 24. This applicator may be inserted through the free edge 27 of the frustoconical portion 26. When the applicator 20 is sunk into said supporting member 24, the free end 221 of the restriction element may butt against an inner surface of the supporting member, for example at a reduction delimiting the frustoconical portion 26 of the barrel 25. In other words, this abutment may take place at the height of the base of the frustoconical portion 26 of the supporting member, opposite to the free edge 27. The applicator 20 can then continue its travel only in the barrel 25 of the supporting member.

The restriction element 220 makes it easier to position the applicator in the supporting member 24. In particular it makes it possible to correctly orient the application means 21. It also prevents damaging the application means when the applicator is inserted into the supporting member.

With the applicator 20 placed in the supporting member 24, the application means 21 of this applicator can if necessary be held tightly on an inner surface of the barrel 26 of the supporting member. The restriction element can then if necessary be extracted from the applicator. These application means 21 may, if necessary, protrude relative to the bottom free end 240 of the supporting member 24. This end 240 is turned towards the receptacle 6 to be connected.

The base 2 can then be positioned in the tube 3. To do this, the supporting member 24 is sunk into this tube so as to snap the claws 28 beneath the sliding edge 331. These claws 28 can then rest against the positioning member 5 in the high position of the supporting member relative to the tube 3. This attachment of the supporting member in the tube may if necessary be permanent. The portion 31 of the tube may if necessary comprise an inner rim capable of retaining the lugs 29 of the supporting member once placed in the tube 3.

The positioning member 5 can interact with the claws 28. In particular, the claws 28 can press on the positioning member 5 in a constricted state during the movement of the base from a high position to a low position relative to the tube 3. The positioning member 5 can, for its part, push the claws 28 during a movement of the base from a low position to its high position. This upward movement of the member of the base may be linked to the elastic releasing of the positioning member 5.

The positioning member 5 can be adapted to hold the supporting member 24 pressing against the reliefs 33. In particular, this positioning member 5 can press the lugs 29 to butt against said reliefs 33, and, as appropriate, against the edge 331 or the ramp 332. These reliefs can therefore form a high, or top, stop for said supporting member 24. These reliefs can axially retain the supporting member 24 along the axis B of the tube.

In this assembled state, the end portion 31 of the tube can be turned towards the frustoconical portion 26 of the supporting member.

The overcapsule 4 can be mounted onto the supporting member 24 so as to cover the free edge 27 in the closed-off position of the application device.

Once the application device 1 has been assembled, the tube 3 can be mounted, as appropriate in a reversible manner, onto the receptacle 6 enclosing the cosmetic product. To do this, the ring 320 of the tube can be mounted by all appropriate means onto the receptacle, and in particular onto the delivery neck of this receptacle. In the example shown, this ring is sleeve-fitted in tight engagement onto the mouth 64 of the neck. Other attachment means such as a snap-fitting, a screwing or a crimping may be provided.

According to an assembly variant, the tube 3 can first be associated with the receptacle 6 then the base 2 housed in this tube 3. As appropriate, the positioning member 5 can be inserted into the tube before said tube is mounted onto the receptacle 6.

The packaging and application assembly according to this embodiment of the invention can then be used.

FIGS. 16 and 17 show the base 2 respectively in the high position and in the low position relative to the tube 3. These high and low positions may respectively correspond to the device 1 shown in FIGS. 3 and 5.

These high and low positions of the base can be defined once the base 2 has been associated with the tube 3, as necessary by snap-fitting. The movement from a high position to a low position of the base 2 can be carried out against an elastic force exerted by the spring 5. To do this, the claws 28 of the supporting member 24 can press against the spring 5 and constrict it. Conversely, the movement from a low position to a high position of the base 2 can be facilitated by the releasing of this spring 5. To do this, the spring can press on to the claws 28 of the supporting member and expand gradually as the irregularities are crossed and as the lugs 29 move across the passageways 30. This movement can therefore be carried out at least partly one flat at a time particularly when the lugs 29 reach their respective ramp 332 provided with the plurality of irregularities 333.

The use of such a device and of such an assembly will now be described in greater detail with reference to FIGS. 3 to 10.

First of all, the cosmetic product contained in the receptacle 6 can be delivered, as necessary, through the delivery orifices 71 of the delivery grid 7. To do this, the packaging and application assembly can be shaken, or even turned over, by the user. The base 2 forming a cap for the product receptacle then retains the product released through the delivery grid 7. A portion of the product can impregnate the application means 21 of the applicator. Another portion can be retained on the delivery grid 7.

As a variant, specific actuation means can be provided. For example, the lateral wall 60 of the receptacle can be deformable, and if necessary compressible, so as to move the product contained in the receptacle 6 in the direction of the delivery opening 61. According to another example, the receptacle could be surmounted by a delivery member of the metering or non-metering pump or valve type, if necessary able to be actuated by the application device 1.

FIG. 3 shows the base 2 in the high position relative to the tube 3. In this position, the lugs 29 can occupy a position in which they are facing the notches 310. In this position, these lugs extend level with their respective insertion passageway 330. Such notches then allow a user to identify the location of these passageways 330 for the purpose of sinking the base 2 into the tube 3.

These notches therefore define indexation or location means. As a variant or additionally, indexation means of the pictogram type can be provided, such as an arrow. Such pictograms can then be provided on the outer surface of the tube 3, level with said passageways 330 (not shown).

FIG. 4 represents the base 2 in a low, sunken, position relative to the tube 3. Such a movement can be made against a return force exerted by the spring 5. In this case, the snap-fitting claws 28 can press on the spring in a constricted state. In this low position, the applicator may if necessary come into contact with the delivery grid of the receptacle 7.

According to the invention, the sliding path makes it possible to guide the movement of the base 2 from its low position to its high position relative to the tube 3, as shown in FIGS. 4-9 for example.

The base can then be rotated relative to the tube 3. To do this, the user can, with one hand, take hold of the tube 3 and, with the other, take hold of the supporting member 24, and turn the supporting member relative to the tube. This rotary movement of the supporting member then causes a secured rotary movement of the applicator that it houses.

In this manner, the lugs 29 can be positioned pressing against their respective edge 331, as illustrated in FIG. 5. In this position, the base is in the low position. In such a position, the applicator may if necessary rub on the delivery grid 7 so as to be more impregnated with cosmetic product retained by this grid.

After a sufficient rotation of the base 2 along the edge 331, for example less than 360°, if necessary less than 180°, and in particular of between 30 and 160°, even between 60 and 120°, the lug can then lead to the ramp 332 provided with said plurality of irregularities 333 as illustrated in FIG. 6.

The base 2 can then be moved in rotation notch by notch on said irregularities. These notches create shakes of the base 2, and thus of the applicator 20, thereby making it possible to remove a surplus of taken cosmetic product from the applicator. The released surplus of product can fall by gravity into the receptacle 6 or the grid 7 covering it, thereby preventing a wastage of product.

The supporting member 24 is acted upon by this spring 5. To do this, this spring presses on the snap-fitting claws 28 of the supporting member 24 so as to move the base 2 from its low position to its high position. The spring 5 then expands with each notch crossed by the lugs 29. This rising movement can therefore be made one flat at a time.

Once this ramp has been passed, the applicator can therefore be impregnated with an efficient dose of product. The lugs 29 can emerge in their respective passageway 330. It should be noted that each lug 29 comes out via the passageway 330 through which the other lug was inserted. More precisely, each lug follows the passageway 330 used by the other lug for the movement of the base from the high position to the low position. In other words, two consecutive high positions of the base, interspersed by a low position, can be obtained by moving the base 2 through approximately 180°. In other words, the base 2 can be moved a half-turn in order to carry out an uptake of product.

Once the base 2 has returned to the high position, the lugs 29 of the supporting member can if necessary be positioned offset, or out of line, relative to the notches 310 and to the insertion passageways 330 of the tube, as illustrated in FIG. 8. The overcapsule 4 can then be extracted from the supporting member so as to extract the applicator from this supporting member, as illustrated in FIG. 10 for the purpose of applying the product impregnating the application means 21 to the bodily application surface concerned. To do this, the hoop 231 of the gripping member can make it easier to grasp the applicator 20 for the purpose of separating it from the supporting member 24, as illustrated in FIG. 9.

If the restriction element 220 has not yet been separated from the applicator 20, particularly following the placing of the applicator in the supporting member, this restriction element can be removed before application. As a variant, it can be retained as a gripping member for the purpose of operating the applicator 20.

FIGS. 18 to 26 represent a second embodiment of a device 1' for applying a cosmetic product, including a care product, according to the invention.

Only the elements of the second embodiment that differ from the elements of the first embodiment will be described. Similar reference numbers with a prime sign added have been allocated to elements of the second embodiment that are similar to the elements of the first embodiment.

This second embodiment differs in particular from the first embodiment in that the gripping member 22' of the applicator 20' and the supporting member 24' form only one element. In other words, the gripping member 22' of the applicator is formed by the supporting member 24'. The base 2' again forms a cap for closing off the tube 3', and more generally the opening of the receptacle 61'.

The applicator 20' can be fitted into the supporting member 24' by any appropriate means, such as by tightening sleeve-fitting, snap-fitting, screwing, bonding, welding or another method.

This supporting member 24' may comprise a summit portion 231' from which extends a lateral skirt 230', possibly cylindrical. In the connected state, this skirt can surround the applicator over at least a portion of its height. This skirt 230' comprises the lugs 29'. This skirt may be concentric to a lengthwise axis of the applicator 20'.

This second embodiment also differs from the first embodiment in that the positioning member 5' comprises no spring but an insert. This insert is received in the tube 3'.

This insert may comprise a tube provided with reliefs 50'. These reliefs may define a sliding edge 50'. In particular, the insert 5' may comprise a cut free edge 50' defining such a sliding edge for the lugs 29'. This sliding edge 50' may have reliefs matching those reliefs 33' of the tube 3' in the mounted position of the insert 5' in the tube 3' as will be further explained in the rest of this description.

The sliding edge 50' may comprise a plurality of sliding-path sectors 51', 52'. More precisely, this free edge may comprise two distinct sliding-path sectors 51', 52'.

The sector 52' may comprise a ramp, possibly provided with irregularities 520'. This ramp may define a helical-profile slope. This ramp may extend on a plane oblique to a lengthwise axis of the insert.

The sector 51' may comprise a circular or horizontal edge 51'. This edge 51' may possibly define a substantially flat portion. This edge may extend on a plane transversal to a lengthwise axis of the insert.

This sector 51' may, as a variant, comprise a ramp. This ramp may also define a helical-profile slope. In this case, this slope may have less of an incline than the slope defined by the ramp 52'. As a variant, this ramp may have a greater incline.

The insert 5' may comprise two diametrically opposed uprights 54' defining externally a respective slide or runner 540' designed for the passage of snap-fitting means 320' of the tube 3' as will be further explained in the rest of this description.

The delivery grid 7' may if necessary be made of a single piece with said insert 5'. As a variant, this grid may be fitted and attached by any appropriate means to the insert, such as by snap-fitting, tightening sleeve-fitting, screwing or another method.

The tube 3' may comprise means for attaching the receptacle 6'. These attachment means may provide a reversible mounting of the tube 3', and of the insert 5' that it houses, in the receptacle. These attachment means may comprise snap-fitting means 320'. These snap-fitting means may comprise claws, as shown in FIG. 25.

The insert 5' may be mounted in the tube 3', if necessary through the end portion 32' of this tube. To do this, the snap-fitting claws 320' are positioned facing the slides 540' if necessary via a means of locating said claws.

These snap-fitting claws 320' can then slide along the slides 540' and then extend at least partly beneath the delivery grid 7'.

In the mounted position of the insert 5' on the tube 3', three sliding sectors may be defined. As seen above, a smaller or larger number of sliding-path sectors may be provided.

In this mounted position, the reliefs 50' of the insert may be positioned facing the reliefs 33' of the tube. These reliefs 50' and 33' may be complementary. Therefore, the ramp 332' of the tube is positioned facing the ramp 52' of the insert. Similarly, the horizontal edge 331' of the tube is positioned facing the horizontal edge 51' of the insert. The vertical groove 330', possibly flared towards the top, in order to make it easier to insert the cap, may be exclusively provided on the tube 3', for example in the continuity of the portion 331'.

In other words, in the mounted position, the reliefs 50' of the insert and the reliefs 33' of the tube can define together a sliding groove capable of guiding the movement of the lugs 29' of the cap. The free edge 50' can define a bottom edge of this groove. The reliefs 33' can define a top edge of this groove. The inner surface of the tube underlying the reliefs 33' may if necessary define the bottom of said groove.

The uprights 540' provide an indexation of the insert 5' relative to the tube 3'. Therefore, after the tube 3' housing the insert 5' is attached to the receptacle 6', the reliefs 33' of the tube and the reliefs 50' of the insert 5' may have corresponding profiles which may extend at least partly facing one another.

Once the tube 3' is in position enveloping the insert 5', this assembly can be mounted on the receptacle 6'. To do this, the claws 320' can be housed under an edge of the mouth 64' of the neck of a receptacle 6'.

In the mounted position of the tube 3' on the receptacle 6', the insert 5' is kept attached by interposition between this tube and this receptacle. This insert may then be limited in movement or even immobilized.

The delivery grid 7' may be formed such that it can extend at least partly inside the receptacle 6' in this mounted position. To do this, the delivery orifices 71' may be wholly or partly provided in a dish formed by the plate 70'.

The device according to this second embodiment is used in a similar manner to the use described with reference to the first embodiment of the invention and will not be described further.

FIGS. 27 and 34 represent a third embodiment of a device 1" for applying a cosmetic product, including a care product, according to the invention.

Only the elements of the third embodiment that differ from the elements of the first embodiment will be described. Similar reference numbers, with a second sign added, have been allocated to elements of the third embodiment that are similar to the elements of the first embodiment.

This third embodiment differs in particular from the first embodiment in that the gripping member 22" of the applicator 20" and the supporting member 24" are only one element. In other words, the gripping member 22" is formed by the supporting member 24". The base 2" again forms a cap for closing off the tube 3", and more generally the opening of the receptacle 61".

The applicator 20" may if necessary be fitted into this cap and attached by any appropriate means, such as by tightening sleeve-fitting, snap-fitting, screwing, bonding, welding or another method.

This cap may comprise a summit portion 231" from which a lateral skirt 230" extends. In the connected state, this skirt may surround the applicator over at least a portion of its height. This skirt may comprise two flat sections.

The supporting member may comprise two opposite lugs 29". These two lugs may extend facing one another. In particular, these lugs may extend from an inner surface of the lateral skirt 230". More precisely, these lugs may extend from a respective flat section of this skirt. This lateral skirt may form a gripping surface of the base 2 for the purpose of applying product.

This exemplary embodiment also shows a positioning member 5" made in a single piece with the receptacle 6". The tube 3" may be made in a single piece with the positioning member 5". The tube 3", the positioning member 5" and the receptacle 6" may therefore be made in a single piece, particularly by injection-moulding of thermoplastic(s).

As a variant, the positioning member 5" may be fitted and attached by any appropriate means to the receptacle 6". The tube 3" may also be fitted to the positioning member. As a variant, the tube and said positioning member may be made in a single piece and fitted to the receptacle 6".

Therefore, in this exemplary embodiment, the tube 3" and the positioning member 5" are made as a unit and form a neck for said receptacle. The sliding path, in this example, is formed by a groove arranged in the thickness of the neck. More precisely, this groove may be provided on an outer surface of the mouth 64" of the receptacle. This groove may be arranged at an intermediate height situated between a receptacle opening 61" and a shoulder 63" of this receptacle.

In particular, this device comprises two opposite grooves situated on either side of this mouth 64". These grooves may be arranged symmetrically relative to an axis C diametrically intersecting the opening 61". This axis may, as a variant or additionally, be a lengthwise axis of the receptacle.

Each groove may be delimited by a bottom edge 50" and a top edge 33" connected by a bottom 321". This groove may define a blind bore opening onto a common terminal portion, at the level of which said top and bottom edges join.

This groove may define one or more sliding-path sectors.

This groove can define a linear sliding path comprising one or more linear sliding sectors. This groove may, for example, comprise a first sliding-path sector 332', 52' forming a ramp extended by a second sliding-path sector 331', 51' extending in a distinct direction. This second sliding-path sector may be a horizontal portion or a ramp with a different slope from that of the first sliding-path sector, for example with a lesser incline. These first and second sliding sectors may for example define together an angle that is strictly smaller than 180°. In particular, this angle may be greater than or equal to 90°, particularly between 100 and 160°, and in particular between 120 and 140°.

As a variant, this groove may comprise at least one curvilinear sliding path, as shown in FIG. 34. This path sector may comprise at least one slope interruption portion or flat, if necessary designed for the reversible attachment of the cap.

Irregularities are provided along the sliding path. Irregularities 520" may, for example, extend from the bottom edge 50" as illustrated in FIG. 33. As a variant, or additionally, irregularities 333" may extend from the top edge 33' as illustrated in FIG. 34. As a variant or additionally, irregularities 322" may extend from the bottom 321" as illustrated in FIG. 32.

These irregularities, when provided on the bottom edge 50" or top edge 33", may be projected facing the bottom 321" of the sliding groove. As a variant, these irregularities may comprise a succession of concavities.

These irregularities are advantageously provided along the ramp 332". As a variant or additionally, they may nevertheless be provided on said horizontal portion or the ramp portion with a distinct slope.

This groove may comprise a reversible means 320" for attaching the cap. The horizontal portion or the portion with a distinct slope may if necessary comprise this reversible means for attaching the base 2". This attachment means may be a means for snap-fitting the base. It may, for example, comprise a protuberance 320" capable of being elastically crossed by the lug 29", for example arranged in the bottom 321" of said groove.

Each groove may, if necessary, comprise a passageway 330" flaring out towards the top, provided upstream of the ramp for the purpose of making it easier to mount the lugs 29" of the base in their respective sliding path.

FIGS. 33 and 34 show the sequential path of a lug 29" in a sliding groove.

The top edge 33" guides the movement of the base 2" from its low position to its high position. This edge therefore provides a top retention or stop for the base 2" on the receptacle up to the passageway 330" for the purpose of its extraction.

In order to move the base 2" from a high position to a low position, the latter is moved relative to the receptacle 6'. To do this, it may be moved by translation relative to the receptacle 6'. Once in the low position, the applicator 20' can be impregnated with cosmetic product contained in the receptacle 6', if necessary by shaking said receptacle. Once the product has been taken, the lugs 29" of the base 2" can be slidingly guided by the top edge 33" of the sliding groove. During this movement, the lugs pass the succession of irregularities provided along this path so as to generate a jerky movement of the base 2" suitable for releasing an excess of the taken product. The user can then apply the taken product resulting from this draining action to the bodily application surface concerned.

According to a variant embodiment not shown, the lugs could be provided on an outer surface of the neck of the receptacle and the base could, for its part, define a respective sliding path configured to receive these lugs. In such a case, this sliding path may extend from a bottom free edge of the cap and be provided with a plurality of irregularities. Such a sliding path may comprise a guidance groove arranged in the thickness of the base.

Throughout the description, the expression "comprising a" or "including a" must be considered as being synonymous with "comprising at least one" or "including at least one", unless the contrary is specified.

Obviously, numerous modifications and variations of the present invention are possible in light of the above teachings. It is therefore to be understood that within the scope of the appended claims, the invention may be practiced otherwise than as specifically described therein.

What is claimed is:

1. Application device comprising:

a base including:

an applicator configured to spread a cosmetic product on a bodily application surface, a member for supporting the applicator comprising a relief; and a tube capable of surrounding the applicator, said base being able to be moved relative to the tube between a high position and a low position, said tube defining a sliding path for the sliding of the supporting member, the sliding path having a plurality of irregularities against which said relief of the supporting member is able to slide so as to create a shaking of the applicator, wherein said sliding path includes a sliding edge suitable for guiding the movement of the base from its low position to its high position, and wherein the tube includes a cylindrical ramp defining at least a portion of the sliding path.

2. A device according to claim 1, comprising a positioning member capable of limiting axial movement of the supporting member relative to the tube.

3. A device according to claim 2, in which the supporting member receives the applicator so as to surround it over at least a portion of its height.

4. A device according to claim 1, in which the supporting member receives the applicator so as to surround it over at least a portion of its height.

5. A device according to claim 1, in which said ramp comprises at least one irregularity amongst said plurality of irregularities.

6. A device according claim 1, in which said sliding path comprises two sectors of sliding path of the supporting member extending in at least two distinct general directions.

7. A device according to claim 1, in which said sliding path comprises a first sector suitable for guiding the applicator in the direction of the product, and a second sector suitable for keeping the applicator close to, or even in contact with, the product.

8. A device according to claim 1, in which the tube comprises two distinct sliding paths each provided with a plurality of irregularities, the supporting member comprising two reliefs, each being configured to slide along their respective sliding path.

9. A device according to claim 8, in which said two sliding paths are symmetrically opposed to one another.

10. A device according claim 1, in which said sliding path comprises reliefs made at least partly in a single piece with said tube.

11. A device according to claim 1, in which said sliding path comprises an insertion passageway for said relief comprising an oblique, helical or vertical groove relative to a lengthwise axis of the tube.

12. A device according to claim 11, in which said base forms a cap closing off said tube.

13. A device according to claim 1, in which the sliding path comprises a sliding edge comprising said plurality of irregularities against which said relief is capable of coming into frictional contact.

14. Assembly for the packaging and application of a cosmetic product comprising a device as defined in claim 1 and a receptacle of cosmetic product.

* * * * *